US008853585B2

(12) United States Patent
Tachikawa et al.

(10) Patent No.: US 8,853,585 B2
(45) Date of Patent: Oct. 7, 2014

(54) ELECTROMAGNETIC CONTRACTOR

(75) Inventors: Hiroyuki Tachikawa, Yokohama (JP); Masaru Isozaki, Ichihara (JP); Osamu Kashimura, Kounosu (JP); Kouetsu Takaya, Kounosu (JP); Yasuhiro Naka, Kounosu (JP); Yuji Shiba, Kounosu (JP)

(73) Assignees: Fuji Electric FA Components & Systems Co., Ltd., Tokyo (JP); Fuji Electric Co., Ltd., Kawasaki-Shi (JP)

( * ) Notice: Subject to any disclaimer, the term of this patent is extended or adjusted under 35 U.S.C. 154(b) by 387 days.

(21) Appl. No.: 13/344,223

(22) Filed: Jan. 5, 2012

(65) Prior Publication Data

US 2012/0175345 A1 Jul. 12, 2012

(30) Foreign Application Priority Data

Jan. 12, 2011 (JP) ..... 2011-004176
Sep. 6, 2011 (JP) ..... 2011-193552

(51) Int. Cl.
*H01H 50/54* (2006.01)
*H01H 9/44* (2006.01)

(52) U.S. Cl.
CPC ..... *H01H 9/443* (2013.01); *H01H 50/546* (2013.01)
USPC ..... 218/26; 335/78; 335/201

(58) Field of Classification Search
CPC ..... H01H 9/44; H01H 9/443; H01H 50/38; H01H 50/54; H01H 50/546
USPC ..... 218/22–26, 34–42, 140–142, 153–156; 335/16, 75–86, 147, 201
See application file for complete search history.

(56) References Cited

U.S. PATENT DOCUMENTS

| | | | | |
|---|---|---|---|---|
| 5,546,061 | A | 8/1996 | Okabayashi et al. | |
| 6,700,466 | B1 | 3/2004 | Yamamoto et al. | |
| 8,390,410 | B2 * | 3/2013 | Kojima et al. | 335/201 |
| 2005/0156469 | A1 | 7/2005 | Nishida et al. | |
| 2010/0289604 | A1 * | 11/2010 | Kojima et al. | 335/156 |

FOREIGN PATENT DOCUMENTS

| | | | |
|---|---|---|---|
| EP | 1168392 | A1 | 1/2002 |
| EP | 1548774 | A2 | 6/2005 |
| FR | 2946793 | A1 | 12/2010 |
| JP | 2008-226547 | | 9/2008 |

OTHER PUBLICATIONS

France Patent Office, "Search Report and Written Opinion for FR 1200066", Jan. 23, 2014.

* cited by examiner

*Primary Examiner* — Amy Cohen Johnson
*Assistant Examiner* — Marina Fishman
(74) *Attorney, Agent, or Firm* — Manabu Kanesaka

(57) ABSTRACT

An electromagnetic contactor includes a first stationary contact having a stationary contact portion and a stationary terminal portion for connecting to a power supply; a second stationary contact having a stationary contact portion and a stationary terminal section for connecting to a load; a stationary-contact supporting case supporting the stationary terminal portions of the first and second stationary contacts to protrude the contact support casing, and maintaining a predetermined distance in between; a moving-contact portion contactable to and separable from the stationary contact portion of the first and second stationary contact and arranged in the stationary-contact supporting case; and a pair of arc-extinguishing magnets arranged in parallel to sandwich the moving-contact portion in the longitudinal direction and having same magnetic polarity at opposing magnetic pole surfaces. A driving mechanism drives the moving-contact portion contactable to and separable from the stationary contact portions of the first and second stationary contacts.

11 Claims, 14 Drawing Sheets

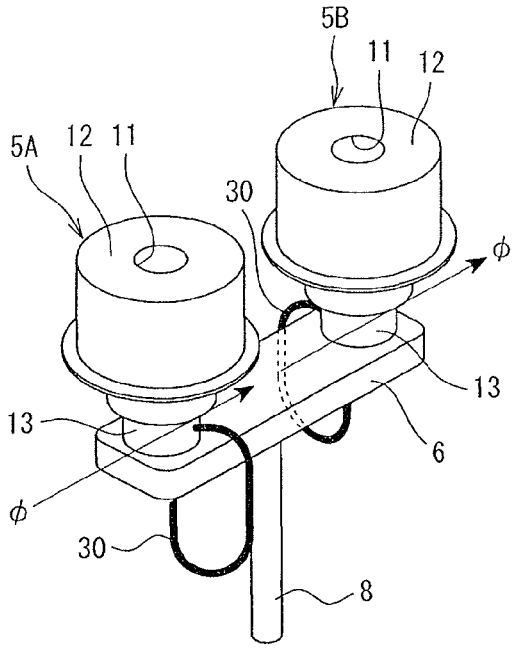
Fig. 9
Fig. 10(a)
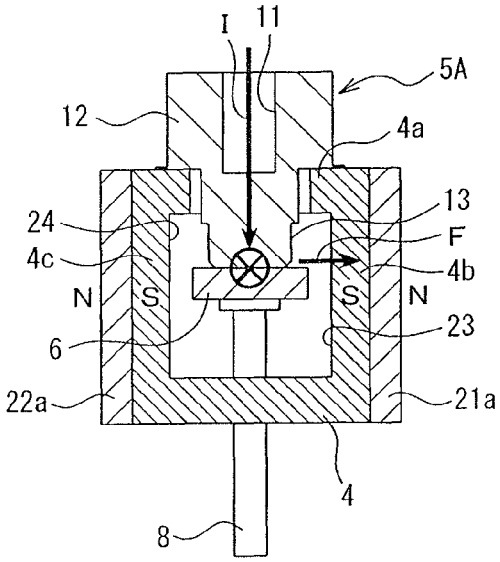
Fig. 10(b)
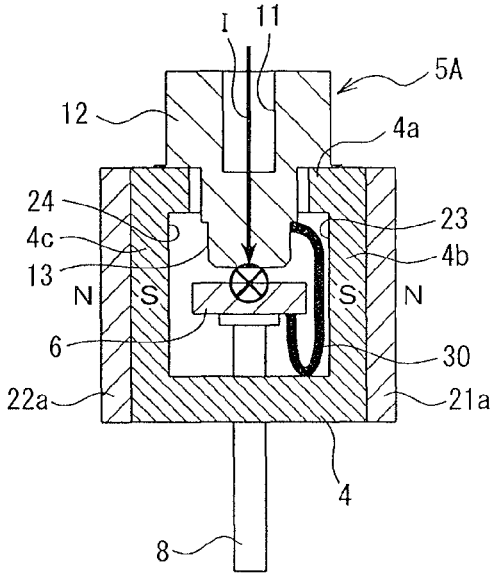

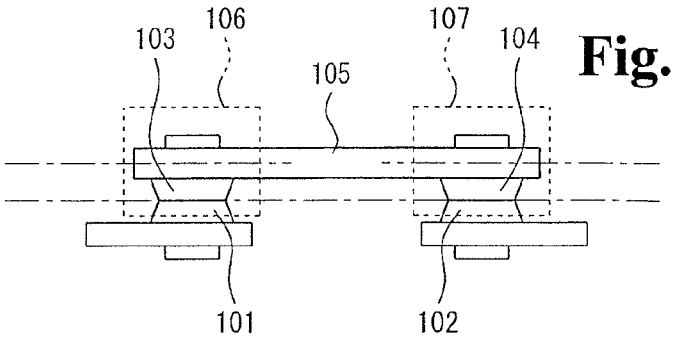
Fig. 25 Prior Art
Fig. 26 Prior Art
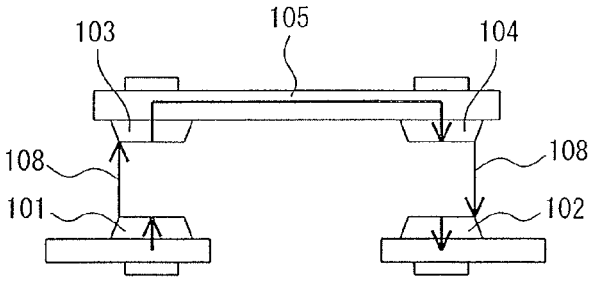
Fig. 27 Prior Art
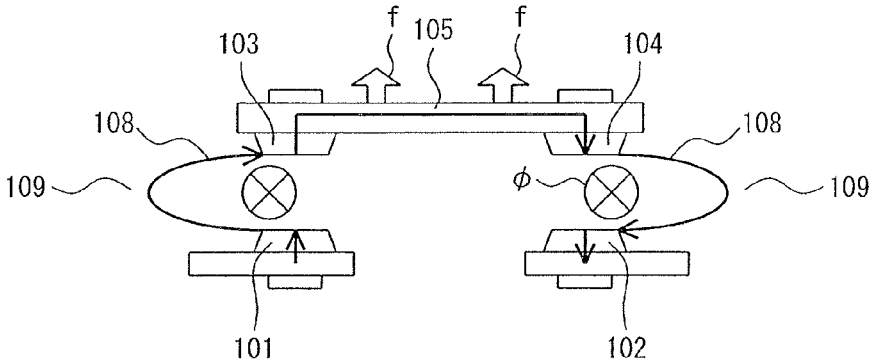

ELECTROMAGNETIC CONTRACTOR

BACKGROUND OF INVENTION

Field of the Invention

The present invention relates to an electromagnetic contactor inserted in a current path and provided with stationary-contact and moving-contact assemblies and particularly to an electromagnetic contactor provided so as to easily extinguish arcs produced at opening of the stationary-contacts and the moving-contact assemblies, i.e. at current interruption.

For an electromagnetic contactor used for a high voltage DC power supply circuit of a vehicle such as an electric vehicle or a hybrid vehicle, a plunger electromagnetic relay having a structure shown in FIG. 24 and FIG. 25 is previously proposed (see JP-A-7-235248, for example). The plunger electromagnetic relay is provided with a pair of stationary contacts 101 and 102 arranged on a housing 100 at a predetermined distance, a moving contact holder 105 provided with a pair of moving contacts 103 and 104 arranged at both ends so that the moving contacts 103 and 104 face the stationary contacts 101 and 102, respectively, for being capable of contacting with and separating from the stationary contacts 101 and 102. The plunger electromagnetic relay is further provided with a pair of arc-extinguishing devices 106 and 107 for extinguishing arcs produced in the gap between the stationary contact 101 and the moving contact 103 and the gap between the stationary contact 102 and the moving contact 104, respectively.

Here, each of the arc-extinguishing devices 106 and 107 is formed of a pair of permanent magnets secured to the housing 100 so that the magnetic polarities of magnetic pole surfaces, facing with a gap provided between the stationary and moving contacts placed in between, become different from each other.

The principle of extinguishing arc in the above example of the related electromagnetic contactor will be explained with reference to FIGS. 25 to 28. Now, letting the state of the plunger electromagnetic relay be changed from the conduction state as is shown in FIG. 25, in which state the moving contact holder 105 contacts the moving contacts 103 and 104 with the stationary contacts 101 and 102, respectively, to let a current flow from the stationary contact 101 toward the stationary contact 102 through the moving contacts 103 and 104, to the current interrupted state as is shown in FIG. 26, in which state the moving contact holder 105 is moved in a solenoid section not shown in the direction of separating the moving contacts 103 and 104 upward from the stationary contacts 101 and 102, respectively, arcs 108 are produced in the gap between the stationary contact 101 and the moving contact 103 and in the gap between the stationary contact 102 and the moving contact 104 as shown in FIG. 26.

At this time, since a pair of the arc-extinguishing devices 106 and 107 is provided so that the direction of the magnetic flux $\phi$ in each of them becomes orthogonal to the paper, namely, orthogonal to each of the arcs 108 as shown in FIG. 27. Thus, a Lorentz force acts on each of the arcs 108 outwardly according to Fleming's left-hand rule in the direction in which the stationary contacts 101 and 102 are arranged. This makes the arc 108 extend onto the side of an arc-extinguishing space 109, arranged on the outside of each of the stationary contacts 101 and 102 shown in FIG. 27 in the direction in which the stationary contacts 101 and 102 are arranged, to be then extinguished.

Moreover, when the direction of current conduction is reversed in which a current flows from the stationary contact 102 onto the side of the stationary contact 101 through the moving contacts 104 and 103, the arcs 108, produced in the gap between the stationary contact 101 and the moving contact 103 and in the gap between the stationary contact 102 and the moving contact 104 as shown in FIG. 27, are extended onto inside in the direction of arranging the stationary contacts 101 and 102 and are made extinguished.

In the example of the related electromagnetic contactor described in JP-A-7-235248, however, a current interruption is made by extending arcs to make an arc voltage larger than a power supply voltage. Since an arc voltage is determined by the product of a value of an arc electric field and a length of the arc, when the interruption of a larger power supply voltage is required, an increase in the value of an arc electric field or an extension in an arc length becomes necessary.

The value of an arc electric field in a certain atmosphere is determined by an inner pressure and a kind of gas and an arc electric field can be generally increased by increasing a gas pressure or by using a gas with a large arc electric field such as hydrogen, for example. However, when a gas pressure is large, there are unsolved problems such as requiring an enhancement of airtightness and structural strength of a vessel. Moreover, when using a gas with a large arc electric field such as hydrogen, there is degradation in a breakdown voltage that necessitates an increase in the gap between contacts. Thus, there is also an unsolved problem of increasing the size of a coil in a solenoid section that drives the moving contact holder.

While, when extending an arc length, there is an unsolved problem in that providing an arc space enough to actualize the extended arc length causes the size of a housing to be enlarged.

For solving these unsolved problems, an electromagnetic relay is proposed in which as shown in FIG. 28, an arc-extinguishing magnet is arranged on the outside of each of a pair of stationary contacts in the direction of arranging the stationary contacts so that the polarities of facing surfaces of the magnets are different from each other. In the electromagnetic relay, on both sides of each of the stationary contacts in the direction orthogonal to the direction in which the stationary contacts are arranged and to the direction of opening and closing the stationary contacts and the moving contacts, arc-extinguishing spaces are arranged for extending arc by a Lorentz force based on the magnetic flux of each of the arc-extinguishing magnets (see JP-A-2008-226547, for example).

[Patent Document 1] JP-A-7-235248

[Patent Document 2] JP-A-2008-226547

Incidentally, in the example of a related electromagnetic relay described in JP-A-2008-226547, as shown in FIG. 29, the arc-extinguishing magnets 111 and 112 are arranged on the respective outsides of a pair of stationary contacts in the direction of arranging the stationary contacts so that the magnetic polarities of facing surfaces of the magnets are different from each other. In this case, most of the magnetic fluxes $\phi$ from the north pole of each of the arc-extinguishing magnets 111 and 112 are magnetic fluxes each changing its direction in a region near the north pole to sideward orthogonal to the longitudinal direction of the moving-contact portion 110, turning around each sideward end of each of the arc-extinguishing magnets 111 and 112 and directly heading toward the south pole of the same magnet. Thus, the magnetic flux heading from the north pole of the arc-extinguishing magnet 112 toward the south pole of the arc-extinguishing magnet 111 along the direction of arranging the stationary contacts and the moving contacts of the moving-contact portion 110 is only the magnetic flux in the sideward central region of the arc-extinguishing magnet 112 arranged orthogonally to the direction in which the moving contacts of the moving-contact portion 110 are arranged.

Here, the magnetic flux density distribution, taken on the line G-G passing the contact section on the side of the arc-extinguishing magnet 112 of the moving-contact portion 110 in FIG. 28, is shown in FIG. 29 as a characteristic curve diagram. In the diagram, the magnetic flux density becomes the maximum at each end in the direction of the width of the arc-extinguishing magnet 112 and becomes the minimum in the central section in the direction of the width. With respect to the contact section on the side of the arc-extinguishing magnet 111, the magnetic flux density also becomes the minimum in the central section in the direction of the width in the same way.

This causes the magnetic flux density of the magnetic flux, intersecting the contacting section of the moving-contact portion 110 contacting with the stationary contact at each end in the longitudinal direction thereof, to become low. Thus, there is an unsolved problem in that a Lorentz force of sufficient magnitude can not be secured which acts on an arc produced between a stationary contact and a moving contact at a current interruption to result in the possibility of making the arc remain between the stationary contact and the contact of the moving-contact portion 110.

For solving the unsolved problems, a magnet with a large coercive force is to be used, which necessitates the use of a large magnet. Thus, there is an unsolved problem of making the electromagnetic contactor large sized.

Accordingly, the invention was made by giving attention to the above unsolved problems in the examples of related electromagnetic contactors with an object of providing an electromagnetic contactor that can be downsized while ensuring an enough arc-extinguishing function regardless of the direction of a current flowing in the contact section.

SUMMARY OF THE INVENTION

For achieving the above object, an electromagnetic contactor according to a first embodiment of the invention includes a first stationary contact having a stationary contact portion and a stationary terminal section connected to a power supply, a second stationary contact having a stationary contact portion and a stationary terminal section connected to a load, and a stationary-contact supporting case supporting the first stationary contact and the second stationary contact with a predetermined distance in between and with the stationary terminal sections of both of the first and second stationary contacts made externally protruded. The first embodiment further includes a moving-contact portion contactable with and separable from the stationary contact portion of the first stationary contact and the stationary contact portion of the second stationary contact and arranged in the stationary-contact supporting case, a pair of arc-extinguishing magnets placed in parallel in the direction orthogonal to the longitudinal direction of the moving-contact portion with the moving-contact portion put in between and with magnetic pole surfaces facing each other made to have the same magnetic polarity, and a driving mechanism driving the moving-contact portion to be contactable with and separable from the stationary contact portion of the first stationary contact and the stationary contact portion of the second stationary contact.

According to the structure, when the electromagnetic contactor is brought from a closed state in which the moving-contact portion contacts the stationary contact portion of the first stationary contact and the stationary contact portion of the second stationary contact into a released state, arcs are produced between the first stationary contact and the moving-contact portion and between the second stationary contact and the moving-contact portion. At this time, since a pair of the arc-extinguishing magnets is placed in the direction orthogonal to the longitudinal direction of the moving-contact portion so as to face each other with the moving-contact portion put in between and the facing magnetic pole surfaces of the arc-extinguishing magnets are magnetized to have the same magnetic polarity, the magnetic fluxes heading from the north poles to the south poles of both of the arc-extinguishing magnets are to traverse the arc produced sections between the first stationary contact and the moving-contact portion and between the second stationary contact and the moving-contact portion in the longitudinal direction of the moving-contact portion. This allows Lorentz forces of sufficient magnitude to act on both of the arcs, by which the arcs are extended in the direction orthogonal to the longitudinal direction of the moving-contact portion to be reliably extinguishable.

An electromagnetic contactor according to a second embodiment of the invention has magnetic polarities of both of the facing magnetic pole surfaces of a pair of the arc-extinguishing magnets made to be the south poles.

According to the structure, a first stationary contact side half of the magnetic flux from the north pole on the external side surface of each of a pair of the arc-extinguishing magnets is to turn around the lateral end on the first stationary contact side of the arc-extinguishing magnet, then traverse a section between the stationary contact portion of the first stationary contact and the moving-contact portion inward in the longitudinal direction of the moving-contact portion before reaching the south pole on the inner surface, i.e. on the facing magnetic pole surface of the arc-extinguishing magnet. Moreover, a second stationary contact side half of the magnetic flux from the north pole of each of the arc-extinguishing magnets is to turn around the lateral end on the second stationary contact side of the arc-extinguishing magnets, then traverse a section between the stationary contact portion of the second stationary contact and the moving-contact portion inward in the longitudinal direction of the moving-contact portion before reaching the south pole on the inner surface, i.e. on the facing magnetic pole surface of the arc-extinguishing magnet. This allows a Lorentz force of sufficient magnitude to act on an arc produced in each of the section between the stationary contact portion of the first stationary contact and the moving-contact portion and the section between the stationary contact portion of the second stationary contact and the moving-contact portion.

An electromagnetic contactor according to a third embodiment of the invention has magnetic polarities of both of the facing magnetic pole surfaces of a pair of the arc-extinguishing magnets made to be the north poles.

According to the structure, a first stationary contact side half of the magnetic flux from the north pole on the inner surface, i.e. on the facing magnetic pole surface of each of a pair of the arc-extinguishing magnets is to traverse a section between the stationary contact portion of the first stationary contact and the moving-contact portion outward in the longitudinal direction of the moving-contact portion, then turn around the lateral end on the first stationary contact side of the arc-extinguishing magnet before reaching the south pole on the external side surface of the arc-extinguishing magnet. Moreover, a second stationary contact side half of the magnetic flux from the north pole of each of the arc-extinguishing magnets is to traverse a section between the stationary contact portion of the second stationary contact and the moving-contact portion outward in the longitudinal direction of the moving-contact portion, then turn around the lateral end on the second stationary contact side of the arc-extinguishing magnet before reaching the south pole on the external side surface of the arc-extinguishing magnet. This allows a Lorentz force of sufficient magnitude to act on an arc produced in each of the section between the stationary contact portion of the first stationary contact and the moving-contact portion and the section between the stationary contact portion of the second stationary contact and the moving-contact portion.

An electromagnetic contactor according to a fourth embodiment of the invention has the stationary-contact supporting case made to have an arc-extinguishing space formed on each of the inner side faces facing the first stationary contact and the moving-contact portion and the second stationary contact and the moving-contact portion.

According to the structure, an arc produced in each of the section between the first stationary contact and the moving-contact portion and the section between the second stationary contact and the moving-contact portion can be extended from the side surface of the stationary contact so as to reach the bottom surface side of the moving-contact portion through the arc-extinguishing space apart from the side surfaces of the stationary contact and the moving-contact portion or in the opposite direction to this by a Lorentz force due to the magnetic fluxes of a pair of the arc-extinguishing magnets.

An electromagnetic contactor according to a fifth embodiment of the invention has the stationary-contact supporting case made to have a holding recess formed on each of facing external side surfaces for holding each of a pair of the arc-extinguishing magnets in a section between the first stationary contact and the second stationary contact.

According to the structure, each of a pair of the arc-extinguishing magnets is held in a holding recess formed in a section between the first stationary contact and the second stationary contact on each of facing external side surfaces. Thus, no arc-extinguishing magnet projects outside to allow the maximum width in the direction orthogonal to the longitudinal direction of the moving-contact portion can be minimized, by an amount of which the electromagnetic contactor can be downsized.

An electromagnetic contactor according to a sixth embodiment of the invention has a pair of the arc-extinguishing magnets made to include a pair of first magnets facing with the first stationary contact and the moving-contact portion put in between and a pair of second magnets facing with the second stationary contact and the moving-contact portion put in between, and the magnetic polarity of each of the facing magnetic pole surfaces of the first magnets and the magnetic polarity of each of the facing magnetic pole surfaces of the second magnets are different from each other.

According to the structure, by choosing the magnetic polarity of each of the facing surfaces of the first magnets as the south pole and the magnetic polarity of each of the facing surfaces of the second magnets as the north pole, for example, the first stationary contact and the moving-contact portion put between a pair of the facing first magnets are to have a magnetic flux traversed inward in the longitudinal direction of the moving-contact portion. Conversely, the second stationary contact and the moving-contact portion put between a pair of the facing second magnets are to have a magnetic flux traversed outward in the longitudinal direction of the moving-contact portion. Thus, with a pair of the first magnets and a pair of the second magnets, Lorentz forces can be made to act on the arcs in the directions opposite to each other to make it possible to reliably prevent the extended arcs from interfering with each other.

An electromagnetic contactor according to a seventh embodiment of the invention has the moving-contact portion made to have at each end in the longitudinal direction thereof one of paired arc-extinguishing auxiliary magnets arranged so as to face the end with the magnetic polarity of the facing magnetic pole surface made differed from the magnetic polarity of the facing magnetic pole surface of each of a pair of the arc-extinguishing magnets.

According to the structure, when the magnetic polarity of each of the facing magnetic pole surfaces of the arc-extinguishing magnets is chosen as the south pole and the magnetic polarity of each of the facing magnetic pole surfaces of the arc-extinguishing auxiliary magnets is chosen as the north pole, for example, almost all of the magnetic fluxes from the north pole of the arc-extinguishing auxiliary magnet are to traverse the contact section of the stationary contact and the moving-contact portion toward the south poles of a pair of the arc-extinguishing magnets. Thus, a magnetic field can be formed in which the magnetic flux passing through the contact section of the stationary contact and the moving-contact portion becomes parallel.

An electromagnetic contactor according to an eighth embodiment of the invention has a yoke arranged which is joined onto the opposite side to the facing magnetic pole surface of each of a pair of the arc-extinguishing magnets and onto the opposite sides to the facing magnetic pole surfaces of the paired arc-extinguishing auxiliary magnets.

According to the structure, the opposite side to the facing magnetic pole surface of each of a pair of the arc-extinguishing magnets and the opposite sides to the facing magnetic pole surfaces of the paired arc-extinguishing auxiliary magnets are joined by the yoke. Thus, the yoke forms closed magnetic circuits to reduce magnetic resistance between an arc-extinguishing magnet and an arc-extinguishing auxiliary magnet in each magnetic circuit, by which the magnetic flux density in a magnetic field driving an arc can be increased. Hence, a driving force exerted on an arc is increased to make it possible to improve interrupting performance. In addition, it becomes possible with small magnets to form a magnetic field with the strength thereof equivalent to that of a magnetic field in the case without providing the yoke, by which the whole structure of the electromagnetic contactor can be downsized.

Moreover, an electromagnetic contactor according to a ninth embodiment of the invention has the yoke formed of a pair of yoke sections each being formed in a C-like shape with the mid section thereof joined onto the opposite side to the facing magnetic pole surface of each of a pair of the arc-extinguishing magnets, and with each of the end sections thereof joined onto the opposite side to the facing magnetic pole surface of each of the paired arc-extinguishing auxiliary magnets.

According to the structure, a pair of the C-like shaped yoke sections is formed to be mounted on their respective arc-extinguishing magnets and the paired arc-extinguishing auxiliary magnets so that each of the yoke sections connects its own arc-extinguishing magnet to the paired arc-extinguishing auxiliary magnets, by which closed magnetic circuits can be easily formed.

According to the invention, in the first stationary contact and the second stationary contact arranged with a predetermined distance in between, the moving-contact portion is arranged to be contactable with and separable from them. Further, in the direction orthogonal to the longitudinal direction of the moving-contact portion, a pair of the arc-extinguishing magnets is arranged with a predetermined distance kept from each of the side surfaces of the moving-contact portion and the magnetic polarity of each of the facing magnetic pole surfaces of a pair of the is made to be the same. This increases the magnetic flux density of the magnetic flux traversing an arc, produced in each of the section between the stationary contact portion of the first stationary contact and the section between the stationary contact portion of the second stationary contact, in the longitudinal direction of the moving-contact portion to make it possible to increase the Lorentz force extending each of the arcs.

Furthermore, the Lorentz force acts on each of the arc produced in the section between the stationary contact portion of the first stationary contact and the moving-contact portion and the arc produced in the section between the stationary contact portion of the second stationary contact and the moving-contact portion to extend the arc toward the arc-extinguishing magnet side in the direction orthogonal to the longitudinal direction connecting the stationary contact portions of the first stationary contact and the second stationary contact. Thus, the arcs can be reliably extinguished regardless of the direction of a current flowing between the first stationary contact and the second stationary contact.

BRIEF DESCRIPTION OF THE DRAWINGS

FIG. 9 is a perspective view illustrating extended states of arcs in the electromagnetic contactor of the second embodiment;

FIG. 10A is a cross-sectional view taken along line C-C in FIG. 8 showing the electromagnetic contactor in a closed state;

FIG. 10B is a cross-sectional view taken along line C-C in FIG. 8 showing the electromagnetic contactor in a released state;

FIG. 25 is a schematic view showing a geometrical relation between contact sections and arc-extinguishing device in a current-carrying state of the example of the related plunger electromagnetic relay;

FIG. 26 is an explanatory view showing a state of arc production in the example of the related plunger electromagnetic relay;

FIG. 27 is a schematic view showing relations among arcs, directions of currents and directions of magnetic fluxes provided by the arc-extinguishing device in an interrupted state in the example of the related plunger electromagnetic relay;

DESCRIPTION OF THE PREFERRED EMBODIMENT

In the following an embodiment of the invention will be explained on the basis of the attached drawings (FIG. 1 to FIG. 6B).

Figure 1:
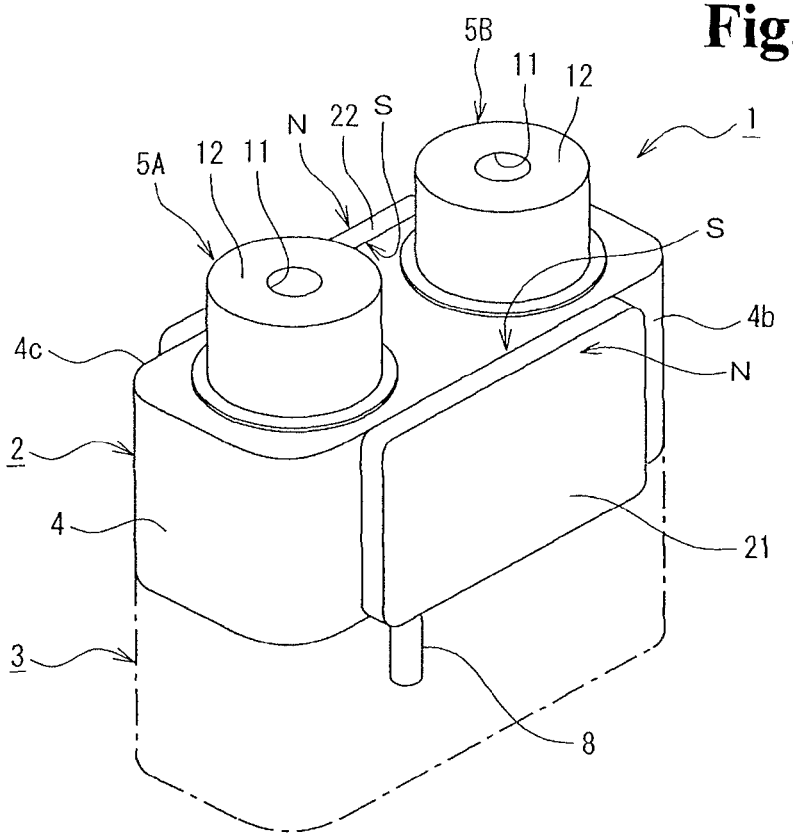
FIG. 1 is a perspective view showing a first embodiment of an electromagnetic contactor according to the invention.

FIG. 1 is a perspective view showing a first embodiment of an electromagnetic contactor according to the invention. In FIG. 1, reference numeral 1 denotes an electromagnetic contactor which is formed of a contact mechanism 2 in an upper section and a driving mechanism 3 in a lower section.

Figure 2:
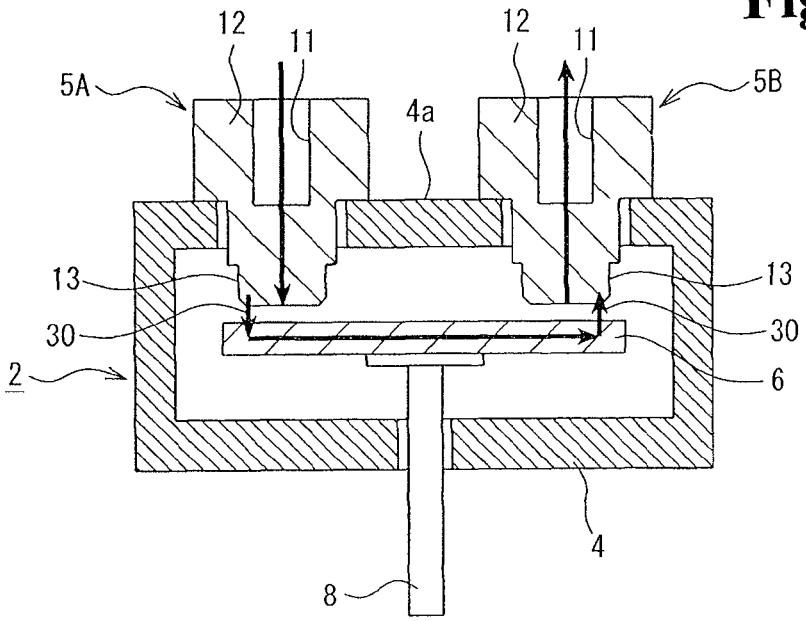
FIG. 2 is a cross-sectional view in the longitudinal direction showing the direction of a current of the first embodiment in FIG. 1.

The contact mechanism 2 is provided with a stationary-contact supporting case 4, a first stationary contact 5A, a second stationary contact 5B and, as shown in FIG. 2, a moving-contact portion 6 arranged in the stationary-contact supporting case 4. The stationary-contact supporting case 4 is formed to have an approximately rectangular-solid-like external shape with an insulating material. The first stationary contact 5A and the second stationary contact 5B are conductive and are held by the stationary-contact supporting case 4 with a predetermined distance from each other. The moving-contact portion 6 is conductive and is arranged in the stationary-contact supporting case 4 so as to be capable of making and breaking contact with the first and second stationary contacts 5A and 5B, respectively.

Each of the first stationary contact 5A and second stationary contact 5B is, as shown in FIG. 2, formed with a stationary terminal section 12 and a stationary contact portion 13. The stationary terminal section 12 is formed into a cylinder-like shape that protrudes upward from an upper surface plate 4*a* of the stationary-contact supporting case 4 with an internal thread section 11 formed from the upper face side. The stationary contact portion 13 connects to the lower face of the stationary terminal section 12 with a diameter smaller than the diameter of the stationary terminal section 12.

In addition, to the stationary terminal section 12 of the first stationary contact 5A, an external connection terminal (not shown) connected to a high voltage DC power supply of hundreds volts, for example, is connected with its external thread section screwed into the internal thread section 11 of the stationary terminal section 12 for being secured. Furthermore, to the stationary terminal section 12 of the second stationary contact 5B, an external connection terminal (not shown) connected to a load is connected with its external thread section screwed into the internal thread section 11 of the stationary terminal section 12 for being secured.

Figure 4:
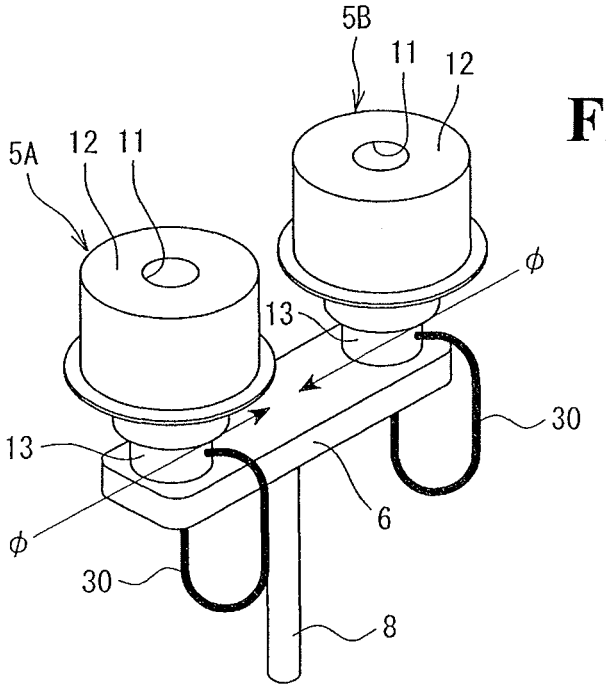
FIG. 4 is a perspective view illustrating extended states of arcs in the electromagnetic contactor of the first embodiment.

Moreover, the moving-contact portion 6, as is shown in FIG. 4, is formed like a flat plate having a length facing the respective stationary contact portions 13 of the first stationary contact 5A and the second stationary contact 5B from beneath them and a width larger than the diameter of the stationary contact portion 13 of each of the first stationary contact 5A and the second stationary contact 5B. In addition, the moving-contact portion 6 is secured to the top end of a shaft 8 protruding from the driving mechanism 3.

The driving mechanism 3, though it is not illustrated, has a core section formed with magnetic material and a plunger positioned inside a coil bobbin with an excitation coil wound thereon. The plunger has a shaft 8 secured thereto. When the excitation coil is in a non-conducting state, the moving-contact portion 6 is separated by a predetermined distance from the stationary contact portion 13 of each of the first stationary contact 5A and second stationary contact 5B, by which the contact mechanism 2 is brought into a released state. When the excitation coil is energized in the released state of the contact mechanism 2, the plunger moves upward to shift an insulator 7 and the moving-contact portion 6 upward through the shaft 8. This makes the moving-contact portion 6 contact the bottom faces of the stationary contact portion 13 of the first stationary contact 5A and the stationary contact portion 13 of the second stationary contact 5B. Thus, the contact mechanism 2 is brought into a closed state.

While, the stationary-contact supporting case 4 has a pair of arc-extinguishing magnets 21 and 22 facing each other to be secured by an adhesive, for example, onto their respective external side surfaces 4*b* and 4*c* being in parallel with the direction in which the first stationary contact 5A and the second stationary contact 5B are arranged, that is, the longitudinal direction of the moving-contact portion 6. Here, each of a pair of the arc-extinguishing magnets 21 and 22 is magnetized in the thickness direction with the facing magnetic pole surface, i.e. the inside surface made to be the same magnetic polarity of the south pole and the back surface, i.e. the outside surface made to be the north pole.

Figure 3:
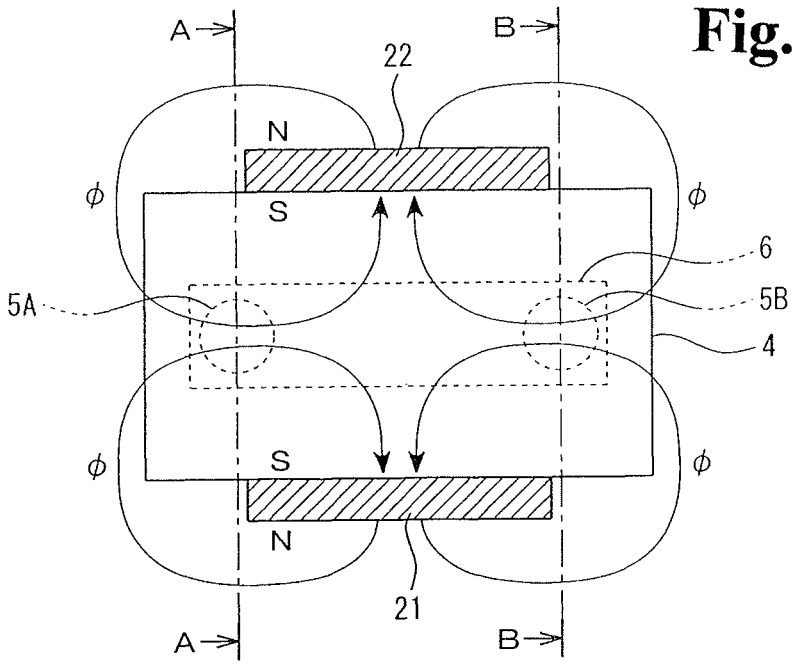
FIG. 3 is an explanatory view showing magnetic fluxes in a magnetic field formed by a pair of arc-extinguishing magnets of the first embodiment.

Each of the arc-extinguishing magnets 21 and 22 is made positioned so that the center in the lateral direction coincides with the center between the central axes of the first stationary contact 5A and the second stationary contact 5B at least with one of the lateral ends being made to approximately face the central axis of the stationary contact portion 13 of the first stationary contact 5A and the other one of the lateral ends being made to approximately face the central axis of the stationary contact portion 13 of the second stationary contact 5B. This forms a magnetic field as shown in FIG. 3 when viewed from a top surface side. In the magnetic field, in each of the arc-extinguishing magnets 21 and 22, the magnetic flux $\phi$ from the north pole on the outside separates rightward and leftward at the central section in the lateral direction. The leftward half of the magnetic flux turns around the left end of the magnet, and then, traverses a section, where the stationary contact portion 13 of the first stationary contact 5A and the moving-contact portion 6 face each other, inward in the longitudinal direction of the moving-contact portion 6 before reaching the south pole. While, the rightward half of the magnetic flux turns around the right end of the magnet, and then, traverses a section, where the stationary contact portion 13 of the first stationary contact 5B and the moving-contact portion 6 face each other, inward in the longitudinal direction of the moving-contact portion 6 before reaching the south pole.

Furthermore, as shown in FIGS. 5A and 5B and FIGS. 6A and 6B, in the stationary-contact supporting case 4, arc-extinguishing spaces 23 and 24 are formed on an inside surface facing the section between the stationary contact portion 13 of the first stationary contact 5A and the moving-contact portion 6 and an inside surface facing the section between the stationary contact portion 13 of the second stationary contact 5B and the moving-contact portion 6, respectively.

Next, an operation of the first embodiment will be explained.

First, to the stationary terminal section 12 of the first stationary contact 5A, an external connection terminal connected to a high voltage DC power supply is connected with its external thread section screwed into the internal thread section 11 of the stationary terminal section 12 for being secured. Then, to the stationary terminal section 12 of the second stationary contact 5B, an external connection terminal connected to a load is connected with its external thread section screwed into the internal thread section 11 of the stationary terminal section 12 for being secured.

In this state, when an unillustrated excitation coil in the driving mechanism 3 is in a non-conducting state, the shaft 8 of the moving-contact portion 6 is shifted downward by a return spring not shown positioned in the driving mechanism 3. Thus, as shown in FIG. 2, the contact mechanism 2 is brought into a released state in which the moving-contact portion 6 is separated by a predetermined distance downward to the respective stationary contact portions 13 of the first stationary contact 5A and the second stationary contact 5B.

This causes the section between the first stationary contact 5A and the second stationary contact 5B to be in a non-conducting state to result in a current cutoff state in which no current from a high voltage power supply is supplied to the load.

When the unillustrated excitation coil in the driving mechanism 3 is energized in the released state, the unillustrated plunger arranged in the driving mechanism 3 moves upward against the force of the return spring, by which the shaft 8 of the moving-contact portion 6 is shifted upward. This, as shown in FIGS. 5A and 5B and FIGS. 6A and 6B, makes the upper face of the moving-contact portion 6 contact the bottom faces of the stationary contact portion 13 of the first stationary contact 5A and the stationary contact portion 13 of the second stationary contact 5B to bring the contact mechanism 2 into a closed state.

In this closed state, a current inputted to the stationary terminal section 12 of the first stationary contact 5A enters the stationary contact portion 13 of the second stationary contact 5B from the stationary contact portion 13 of the first stationary contact 5A through the moving-contact portion 6 to bring the contact mechanism 2 into a current supplying state in which the current is supplied to the load from the stationary terminal section 12 of the second stationary contact 5B.

Thereafter, an interruption of conduction to the excitation coil in the driving mechanism 3 for canceling the current supplying state makes the unillustrated plunger to start descending by the return spring. Thus, in the contact mechanism 2, the moving-contact portion 6 is separated downward from the stationary contact portions 13 of the first stationary contact 5A and the second stationary contact 5B as shown in FIG. 2. At this time, in each of the spaces between the moving-contact portion 6 and the stationary contact portions 13 of the first stationary contact 5A and the second stationary contact 5B, an arc 30 is produced, by which the conducting state of the current is continued.

At this time, the polarities of the magnetic pole surfaces of the arc-extinguishing magnets 21 and 22 facing each other are south poles with the polarities of the outside surfaces of which being the north poles. This forms a magnetic field as shown in FIG. 3 when viewed from a top surface side. In the magnetic field, the magnetic flux from the north pole turns around both lateral ends of each of the arc-extinguishing magnets 21 and 22, then traverses an arc-producing section, a section where the stationary contact portion 13 of the first stationary contact 5A and the moving-contact portion 6 face each other, inward in the longitudinal direction of the moving-contact portion 6 before reaching the south pole. Along with this, the magnetic flux also traverses the other arc-producing section, a section where the stationary contact portion 13 of the second stationary contact 5B and the moving-contact portion 6 face each other, inward in the longitudinal direction of the moving-contact portion 6 before reaching the south pole.

Figure 5A:
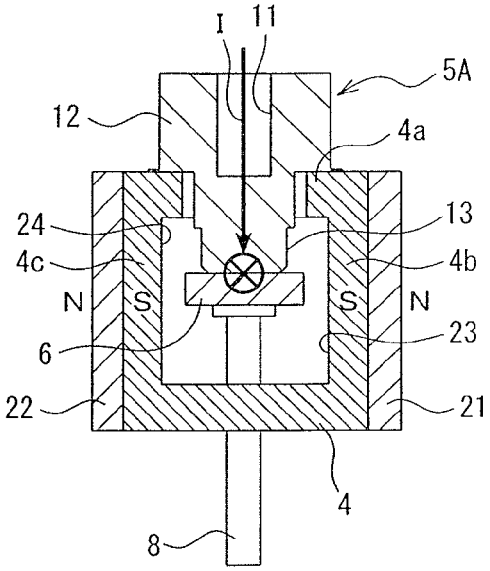
FIG. 5A is a cross-sectional view taken along line A-A in FIG. 3 showing the electromagnetic contactor in a closed state.
Figure 5B:
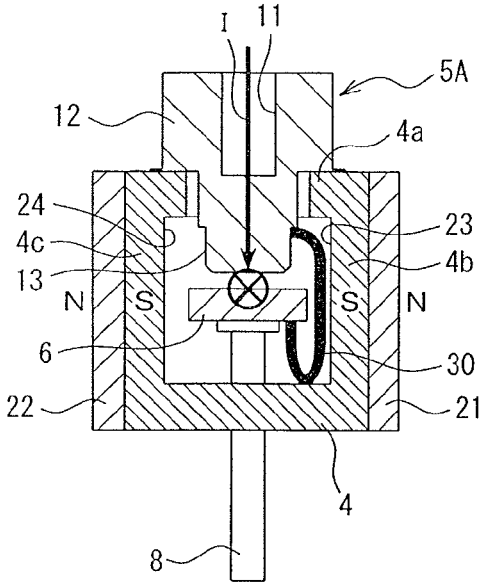
FIG. 5B is a cross-sectional view taken along line A-A in FIG. 3 showing the electromagnetic contactor in a released state.

Therefore, both of the magnetic fluxes of the arc-extinguishing magnets 21 and 22 are to traverse the section between the stationary contact portion 13 of the first stationary contact 5A and the moving-contact portion 6 inward in the longitudinal direction of the moving-contact portion 6. Both of the magnetic fluxes of the arc-extinguishing magnets 21 and 22 are to also traverse the section between the stationary contact portion 13 of the second stationary contact 5B and the moving-contact portion 6 inward in the longitudinal direction of the moving-contact portion 6 in the direction opposite to the direction of the magnetic fluxes in the section between the stationary contact portion 13 of the first stationary contact 5A and the moving-contact portion 6. Thus, in the section between the stationary contact portion 13 of the first stationary contact 5A and the moving-contact portion 6, as shown in FIG. 5B, a current I flows from the first stationary contact 5A side to the moving-contact portion 6 side. Along with this, the direction of the magnetic flux $\phi$ becomes the direction toward the paper. Thus, according to Fleming's left-hand rule, a Lorentz force of large magnitude acts in the direction of the arc-extinguishing magnet 21 side which direction is orthogonal to the longitudinal direction of the moving-contact portion 6 and orthogonal to the direction of opening and closing the stationary contact portion 13 of the first stationary contact 5A and the moving-contact portion 6. By the Lorentz force, an arc 30, produced between the stationary contact portion 13 of the first stationary contact 5A and the moving-contact portion 6, is largely extended as shown in FIG. 5B from the side surface of the stationary contact portion 13 of the first stationary contact 5A so as to reach the bottom surface side of the moving-contact portion 6 through the inside of the arc-extinguishing space 23 formed inside of the arc-extinguishing magnet 21 to be extinguished. In addition, in the arc-extinguishing spaces 23, on the upper side and the lower side thereof, the magnetic flux is to incline upward and downward to the direction of the magnetic flux between the stationary contact portion 13 of the first stationary contact 5A and the moving-contact portion 6. Thus, by the inclined magnetic flux, the arc 30 extended in the arc-extinguishing space 23 is further extended toward the corner of the arc-extinguishing spaces 23, by which the arc length can be lengthened to make it possible to obtain a good interrupting performance.

Figure 6A:
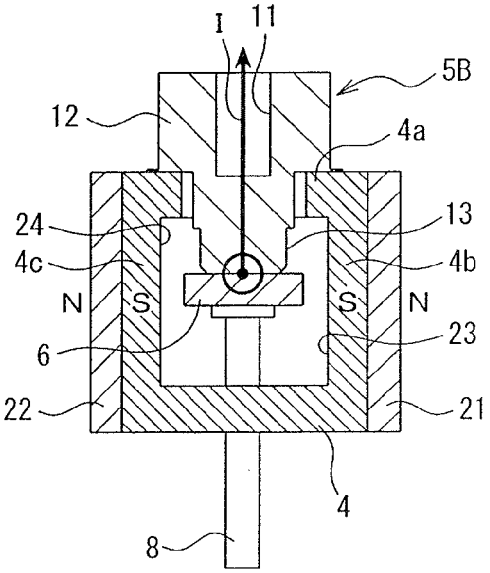
FIG. 6A is a cross-sectional view taken along line B-B in FIG. 3 showing the electromagnetic contactor in a closed state.
Figure 6B:
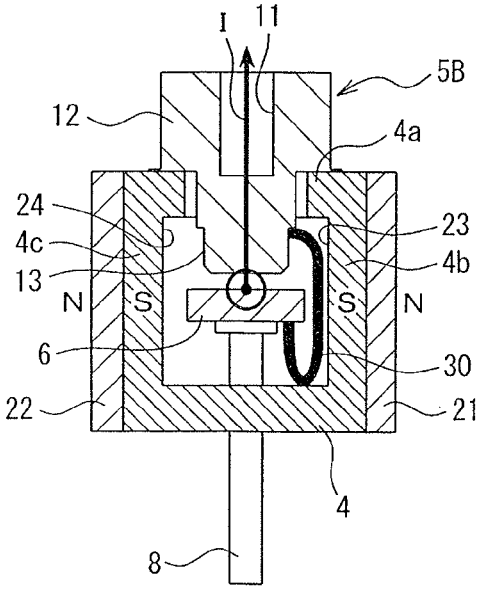
FIG. 6B is a cross-sectional view taken along line B-B in FIG. 3 showing the electromagnetic contactor in a closed state.

While, in the section between the stationary contact portion 13 of the second stationary contact 5B and the moving-contact portion 6, as shown in FIG. 6B, a current I flows from the moving-contact portion 6 side to the second stationary contact 5B side. Along with this, the direction of the magnetic flux $\phi$ becomes the direction toward this side from the paper. Thus, according to Fleming's left-hand rule, a Lorentz force of large magnitude acts in the direction of the arc-extinguishing magnet 21 side which direction is orthogonal to the longitudinal direction of the moving-contact portion 6 and orthogonal to the direction of opening and closing the stationary contact portion 13 of the second stationary contact 5B and the moving-contact portion 6. By the Lorentz force, an arc 30, produced between the stationary contact portion 13 of the second stationary contact 5B and the moving-contact portion 6, is largely extended so as to reach the side face side of the stationary contact portion 13 of the second stationary contact 5B from the bottom surface side of the moving-contact portion 6 through the inside of the arc-extinguishing space 23 formed inside of the arc-extinguishing magnet 21 as shown in FIG. 6B to be extinguished. In addition, in the arc-extinguishing space 23, as was explained in the foregoing, on the upper side and the lower side thereof, the magnetic flux is to incline upward and downward to the direction of the magnetic flux between the stationary contact portion 13 of the second stationary contact 5B and the moving-contact portion 6. Thus, by the inclined magnetic flux, the arc 30 extended in the arc-extinguishing space 23 is further extended toward the corner of the arc-extinguishing spaces 23, by which the arc length can be lengthened to make it possible to obtain a good interrupting performance.

Compared with this, when the electromagnetic contactor 1 in a closed state is brought into a released state with a regenerated current flowing from the load side to the DC power supply side, a similar arc-extinguishing function is exhibited except that the direction of the current shown in the above explained FIGS. 5A and 5B and FIGS. 6A and 6B is reversed to make a Lorentz force act toward the arc-extinguishing magnets 22 side to extend the arc 30 onto the arc-extinguishing spaces 24 side.

In this way, according to the first embodiment, in the direction orthogonal to the longitudinal direction of the moving-contact portion 6, the arc-extinguishing magnets 21 and 22 are arranged so as to face each other with the first stationary contact 5A, the second stationary contact 5B and the moving-contact portion 6 provided in between, and the facing magnetic pole surfaces of the arc-extinguishing magnets 21 and 22 are made to have the same polarities.

Thus, both of the magnetic fluxes from the arc-extinguishing magnets 21 and 22 are to traverse the section between the first stationary contact 5A and the moving-contact portion 6 and the section between the second stationary contact 5B and the moving-contact portion 6 in the longitudinal direction of the moving-contact portion 6.

Therefore, the magnetic flux density of the magnetic flux that traverses each of the section between the first stationary contact 5A and the moving-contact portion 6 and the section between the second stationary contact 5B and the moving-contact portion 6 can be made to be significantly increased compared with the magnetic flux density in the previously explained example of the related electromagnetic contactor. By such a magnetic flux and a flow of current in each of the section between the first stationary contact 5A and the moving-contact portion 6 and the section between the second stationary contact 5B and the moving-contact portion 6, a Lorentz force of large magnitude can be made to act toward either the arc-extinguishing magnets 21 or 22 according to the Fleming's left-hand rule.

By the Lorentz force, the arc 30 is largely extended to either of the arc-extinguishing space 23 or 24 formed on the inner side face of the stationary-contact supporting case 4 to allow the arc 30 to be extinguished. Therefore, a DC high voltage can be interrupted without increasing the coercive forces of the arc-extinguishing magnet 21 or 22, by which the electromagnetic contactor can be downsized. In addition, the arc 30 extended from the stationary contact portion 13 of the first stationary contact 5A and the moving-contact portion 6 and the arc 30 extended from the stationary contact portion 13 of the second stationary contact 5B and the moving-contact portion 6 do not come closer to each other even though the direction of a current is reversed, which can reliably prevent both arcs from interfering each other.

Moreover, when the direction of the current flowing in the section between the stationary contact portion 13 of the first stationary contact 5A and the moving-contact portion 6 and the direction of the current flowing in the section between the stationary contact portion 13 of the second stationary contact 5B and the moving-contact portion 6 are reversed, the Lorentz force acts in the reverse direction. Namely, onto which side of the longitudinal direction of the moving-contact portion 6, that is, onto which side of the arc-extinguishing magnet 21 or 22 the arc 30 is extended is determined by the direction of a current flowing the section between the stationary contact portion 13 of the first stationary contact 5A and the moving-contact portion 6 and the section between the stationary contact portion 13 of the second stationary contact 5B and the moving-contact portion 6.

Therefore, by providing the arc-extinguishing spaces 23 and 24 on both sides of the longitudinal direction of the moving-contact portion 6, namely on the sides of the arc-extinguishing magnets 21 and 22, respectively, a reliable arc-extinguishing function can be exhibited regardless of the direction of an arc current, namely the direction of a current flowing in the section between the stationary contact portion and the moving-contact portion.

As was explained in the foregoing, according to the first embodiment, a small-sized electromagnetic contactor can be provided which has a sufficient arc-extinguishing function for a high voltage power supply regardless of the direction of a current flowing in the contact section.

In the first embodiment described in the foregoing, explanations were made with respect to the case in which the magnetic polarities of the facing magnetic pole surfaces of the arc-extinguishing magnets 21 and 22 were made to be the south poles. The invention, however, is not limited to this, but the magnetic polarities of the facing magnetic pole surfaces can be made to be the north poles.

In this case, a first stationary contact 5A side half of the magnetic flux from the north pole on the inside surface of each of the arc-extinguishing magnets 21 and 22 is to pass through the section between the stationary contact portion 13 of the first stationary contact 5A and the moving-contact portion 6 before reaching the south pole on the external side surface. Along with this, a second stationary contact 5B side half of the magnetic flux from the north pole on the inside surface of each of the arc-extinguishing magnets 21 and 22 is to pass through the section between the stationary contact portion 13 of the second stationary contact 5B and the moving-contact portion 6 before reaching the south pole on the external side surface.

Therefore, except that the acting direction of the Lorentz force is reversed, a working effect similar to that of the first embodiment can be obtained.

Next to this, a second embodiment of the invention will be explained with reference to FIG. 7 to FIG. 11B.

In the second embodiment, each of a pair of the arc-extinguishing magnets 21 and 22 in the above-explained first embodiment is provided so as to be divided into a set of two magnets arranged in the lateral direction.

Figure 7:
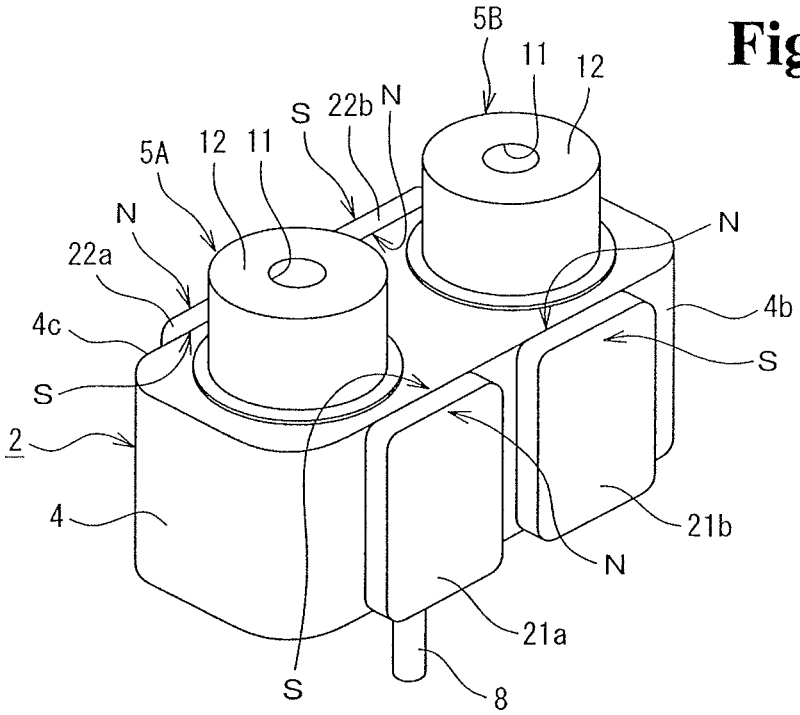
FIG. 7 is a perspective view showing a second embodiment of an electromagnetic contactor according to the invention.
Figure 8:
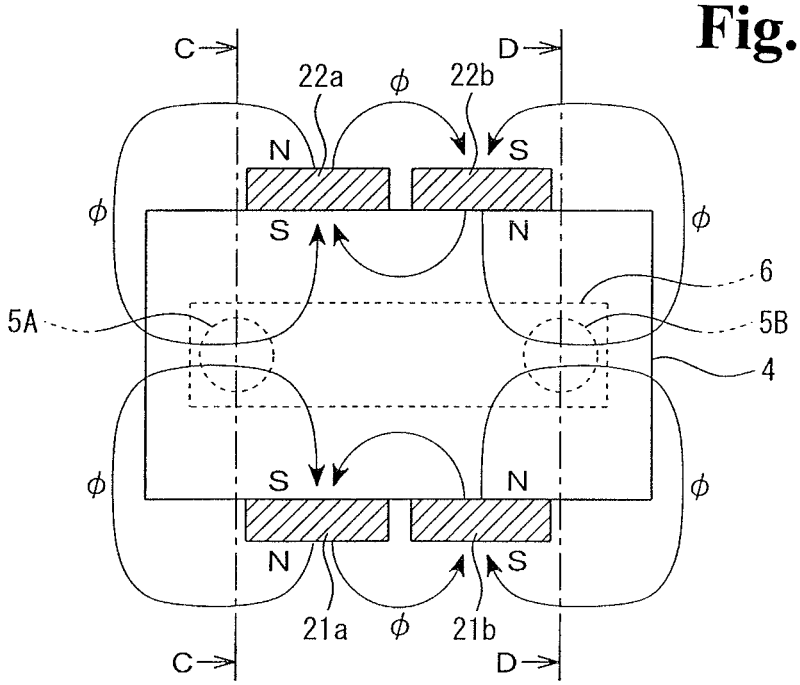
FIG. 8 is an explanatory view showing magnetic fluxes in a magnetic field formed by arc-extinguishing magnets of the second embodiment.

Namely, the second embodiment, as shown in FIG. 7 and FIG. 8, has the same structure as the structure of the previously explained first embodiment shown in FIG. 1 and FIG. 3 except that a pair of the arc-extinguishing magnets 21 and 22 in the previously explained first embodiment is formed of a set of two divided magnets 21*a* and 21*b* and a set of two divided magnets 22*a* and 22*b*, respectively, with a gap of a predetermined length provided between each of the set of the divided magnets 21*a* and 21*b* and the set of the divided magnets 22*a* and 22*b*. Thus, in the second embodiment, sections equivalent to those shown in FIG. 1 and FIG. 3 will be denoted with the same reference numerals and signs with detailed explanations thereof omitted.

Here, of the divided magnets 21*a*, 21*b*, 22*a* and 22*b*, the facing magnetic pole surfaces of a pair of the divided magnets 21*a* and 22*a* facing each other in a half section are made to have the same magnetic polarities of, for example, the south poles. Moreover, the facing magnetic pole surfaces of a pair of the divided magnets 21*b* and 22*b* facing each other in the other half section are made to have the same magnetic polarities of the north poles, which are different from the magnetic polarities of the facing magnetic pole surfaces of a pair of the divided magnets 21*a* and 22*a*.

According to the second embodiment, the facing magnetic pole surfaces of a pair of the divided magnets 21*a* and 22*a* are made to be the south poles, which surfaces face each other with the stationary contact portion 13 of the first stationary contact 5A and the moving-contact portion 6 facing thereto put in between. Moreover, a pair of the divided magnets 21*b* and 22*b*, positioned with a gap of a predetermined length opened in the lateral direction to a pair of the divided magnets 21*a* and 22*a*, is arranged to face each other with the stationary contact portion 13 of the first stationary contact 5B and the moving-contact portion 6 facing thereto in between, and the magnetic polarities of the facing magnetic pole surfaces of both of the divided magnets 21*b* and 22*b* are made to be the north poles.

Thus, a magnetic field is formed by the divided magnets 21*a*, 22*a*, 21*b* and 22*b* as shown in FIG. 8 when viewed from a top surface side. In the magnetic field, a left half of the magnetic flux from the north pole on the outside of the divided magnet 21*a* turns around the outside of the stationary-contact supporting case 4 and reaches the south pole of the divided magnet 21*a* itself through the section between the stationary contact portion 13 of the first stationary contact 5A and the moving-contact portion 6. While, the other right half of the magnetic flux reaches the south pole on the outside of the adjacent divided magnet 21*b*.

Conversely, a left half of the magnetic flux from the north pole on the inside of the divided magnet 21*b* reaches the south pole on the inside of the adjacent divided magnet 21*a*. While, the other right half of the magnetic flux passes through the section between the stationary contact portion 13 of the second stationary contact 5B and the moving-contact portion 6, turns around the outside of the stationary-contact supporting case 4 and reaches the south pole of the divided magnet 21*b* itself.

In the same way, a left half of the magnetic flux from the north pole on the outside of the divided magnet 22*a* turns around the outside of the stationary-contact supporting case 4 and reaches the south pole of the divided magnet 22*a* itself through the section between the stationary contact portion 13 of the first stationary contact 5A and the moving-contact portion 6. While, the other right half of the magnetic flux reaches the south pole on the outside of the adjacent divided magnet 22*b*.

Conversely, a left half of the magnetic flux from the north pole on the inside of the divided magnet 22*b* reaches the south pole on the inside of the adjacent divided magnet 22*a*. While, the other right half of the magnetic flux passes through the section between the stationary contact portion 13 of the second stationary contact 5B and the moving-contact portion 6, turns around the outside of the stationary-contact supporting case 4 and reaches the south pole of the divided magnet 22*b* itself.

Therefore, in the section between the stationary contact portion 13 of the first stationary contact 5A and the moving-contact portion 6, the magnetic fluxes from the divided magnets 21*a* and 22*a* traverse inward in the longitudinal direction. Conversely, in the section between the stationary contact portion 13 of the second stationary contact 5B and the moving-contact portion 6, the magnetic fluxes from the divided magnets 21*b* and 22*b* traverse outward in the longitudinal direction.

Moreover, suppose that the electromagnetic contactor is brought into a closed state in which a current is supplied in the excitation coil in the driving mechanism 3 to raise the moving-contact portion 6 through the shaft 8 to contact the bottom faces of the stationary contact portions 13 of the first and second stationary contacts 5A and 5B. When the electromagnetic contactor is brought into the closed state, as is shown in FIG. 10A, in the section between the first stationary contact 5A and the moving-contact portion 6, a current flows from the stationary contact portion 13 of the first stationary contact 5A to the moving-contact portion 6 side, and along with this, magnetic fluxes traverse the section in the direction to the paper.

Figure 11A:
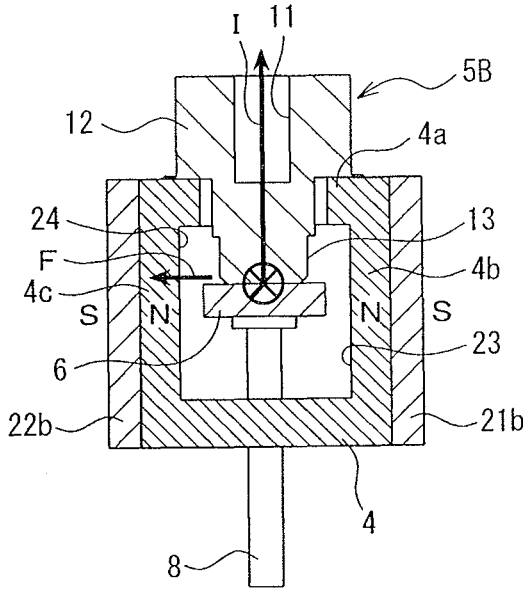
FIG. 11A is a cross-sectional view taken along line D-D in FIG. 8 showing the electromagnetic contactor in a closed state.

In the same way, in the section between the second stationary contact 5B and the moving-contact portion 6, as is shown in FIG. 11A, a current flows from the moving-contact portion 6 to the stationary contact portion 13 of the second stationary contact 5B, and along with this, magnetic fluxes traverse the section in the direction to the paper.

Thus, when the electromagnetic contactor is shifted from a closed state to a released state, the production of an arc 30, occurring in the section between each of the stationary contact portions 13 of the first and second stationary contacts 5A and 5B and the moving-contact portion 6 due to the separation of them, causes a Lorentz force F of large magnitude to act on the arc 30 toward the divided magnet 21*a* in the section between the first stationary contact 5A and the moving-contact portion 6 as shown in FIG. 10A.

By the Lorentz force F, the produced arc 30 is extended long as shown in FIG. 10B from the side surface of the stationary contact portion 13 of the first stationary contact 5A so as to reach the bottom surface side of the moving-contact portion 6 through the arc-extinguishing space 23 on the side of the divided magnet 21*a* from top to bottom to be extinguished.

In addition, in the arc-extinguishing spaces 23, on the upper side and the lower side thereof, the magnetic flux is to incline upward and downward to the direction of the magnetic flux between the stationary contact portion 13 of the first stationary contact 5A and the moving-contact portion 6. Thus, by the inclined magnetic flux, the arc 30 extended into the arc-extinguishing space 23 is further extended toward the corner of the arc-extinguishing spaces 23, by which the arc length can be lengthened to make it possible to obtain a good interrupting performance.

Figure 11B:
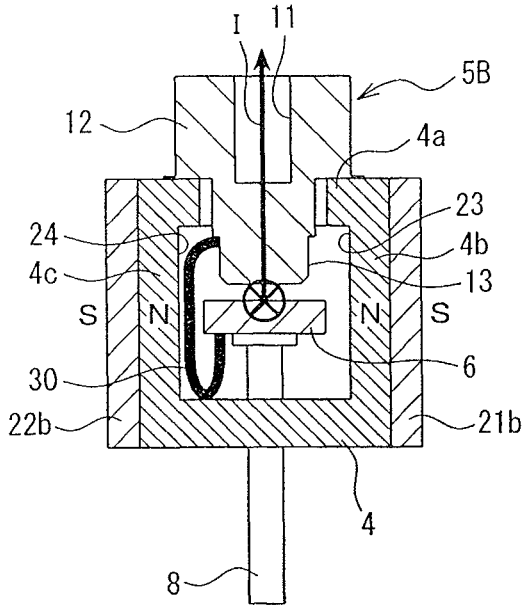
FIG. 11B is a cross-sectional view taken along line D-D in FIG. 8 showing the electromagnetic contactor in a released state.

While, in the section between the stationary contact portion 13 of the second stationary contact 5B and the moving-contact portion 6, as shown in FIG. 11A, a Lorentz force F of large magnitude acts on a produced arc 30 in the direction of the divided magnet 22*b*. By the Lorentz force F, the produced arc 30, as shown in FIG. 11B, is extended long so as to reach the side surface of the stationary contact portion 13 of the second stationary contact 5B from the bottom surface side of the moving-contact portion 6 through the arc-extinguishing space 24 on the side of the divided magnet 22*b* from bottom to top to be extinguished.

In addition, in the arc-extinguishing spaces 24, on the upper side and the lower side thereof, the magnetic flux is to incline upward and downward to the direction of the magnetic flux between the stationary contact portion 13 of the second stationary contact 5B and the moving-contact portion 6. Thus, by the inclined magnetic flux, the arc 30 extended into the arc-extinguishing space 23 is further extended toward the corner of the arc-extinguishing spaces 24, by which the arc length can be lengthened to make it possible to obtain a good interrupting performance.

In this way, according to the second embodiment, the arc 30, produced when the electromagnetic contactor is shifted from a closed state to a released state, is extended onto the arc-extinguishing space 23 side on the first stationary contact 5A side as shown in FIG. 9. While, on the second stationary contact 5B side, the produced arc 30 is extended onto the arc-extinguishing space 24 side on the opposite side of the arc-extinguishing space 23.

This makes the extended arcs 30 pass through their respective arc-extinguishing spaces 23 and 24 on the sides opposing each other to make it possible to reliably prevent the extended arcs 30 from interfering with each other. Thus, the distance between the first stationary contact 5A and the second stationary contact 5B can be shortened. Consequently, the electromagnetic contactor can be downsized.

Moreover, with the direction of the current flowing in the section between the stationary contact portion 13 of the first stationary contact 5A and the moving-contact portion 6 and the section between the stationary contact portion 13 of the second stationary contact 5A and the moving-contact portion 6 being reversed, the Lorentz force also acts in the reverse direction. Namely, in which of the two directions the arc 30 is extended, each of which two directions is orthogonal to the direction of opening and closing the contact section between the stationary contact portion 13 of each of the first stationary contact 5A and the second stationary contact 5B and the moving-contact portion 6 and is orthogonal to the direction of the magnetic flux formed in the contact section by the divided magnets, is determined by the direction of a current flowing the contact sections. Therefore, by providing the arc-extinguishing spaces on both sides of the moving-contact portion 6, namely on the sides of both of the set of the divided magnets 21*a* and 21*b* and the set of the 22*a* and 22*b*, in the direction orthogonal to the direction of opening and closing the contact section and orthogonal to the direction of the magnetic flux formed by the divided magnets, an arc can be sufficiently extinguished.

In this way, by a pair of the arc-extinguishing spaces 23 and 24, an arc can be sufficiently extinguished to make it possible to provide the electromagnetic contactor as being made compact. Namely, without providing a large gap in the contact section, an arc can be made sufficiently extinguished by a pair of the arc-extinguishing spaces. Moreover, also in the case in which two contact sections, for example, are formed without making the contact sections arranged while being isolated with a relatively large distance for providing a space for distinguishing arcs, the arcs can be extended to the arc-extinguishing spaces.

From the description in the foregoing, a small-sized electromagnetic contactor can be obtained which can exhibit a sufficient arc-extinguishing function regardless of the direction of a current flowing in the contact section.

In the second embodiment, explanations were made with respect to the case in which the polarities of the facing magnetic pole surfaces of the divided magnets 21*a* and 22*a* were chosen as the south poles and the polarities of the facing magnetic pole surfaces of the divided magnets 21*b* and 22*b* were taken as the south poles. The invention, however, is not limited to this, but even though the polarities of the facing magnetic pole surfaces of the divided magnets 21*a* and 22*a* are chosen as the north poles and the polarities of the facing magnetic pole surfaces of the divided magnets 21*b* and 22*b* are chosen as the south poles, a working effect similar to that of the second embodiment can be obtained.

Subsequent to this, a third embodiment of the invention will be explained with reference to FIG. 12 to FIG. 16.

In the third embodiment, the distance between the side surfaces of an electromagnetic contactor 1, on each of which surfaces an arc-extinguishing magnet is arranged, is to be made shortened.

Figure 12:
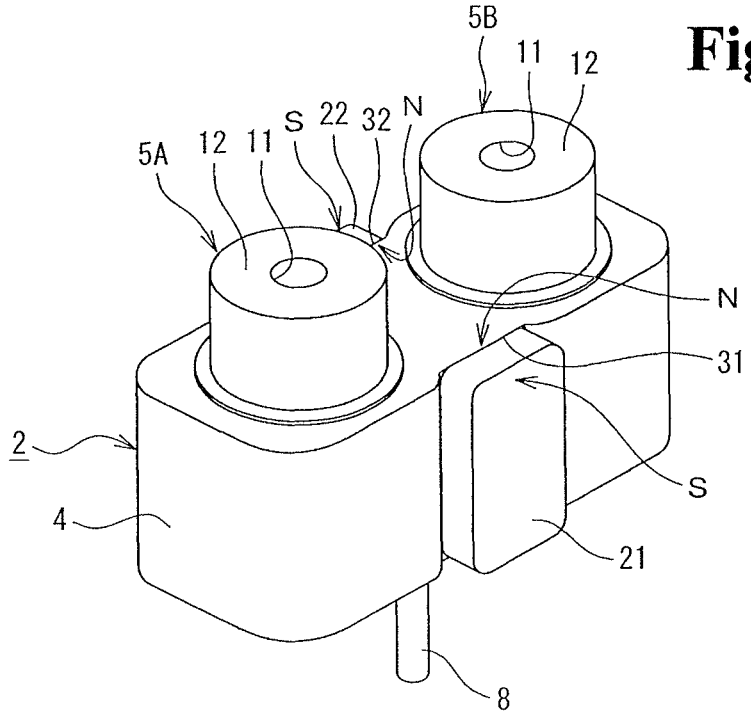
FIG. 12 is a perspective view showing a third embodiment of an electromagnetic contactor according to the invention.
Figure 13:
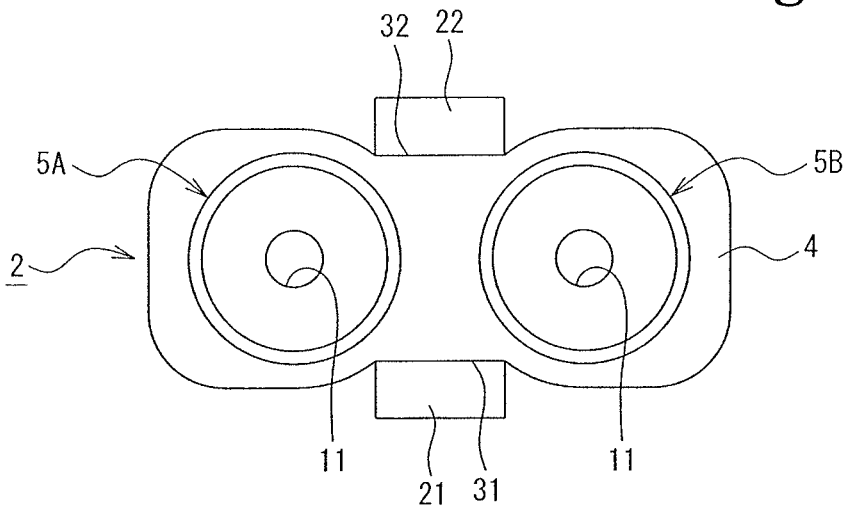
FIG. 13 is a plan view showing the third embodiment of an electromagnetic contactor according to the invention.

Namely, in the third embodiment, as is shown in FIG. 12 and FIG. 13, the section between a first stationary contact 5A and a second stationary contact 5B are made to be narrowed inward, namely, onto the side of the moving-contact portion 6, into a form with a narrow width having holding recesses 31 and 32 formed thereon.

In addition, in the holding recesses 31 and 32, rectangular arc-extinguishing magnets 21 and 22 each with vertically long sides are arranged. In this way, the stationary-contact supporting case 4 has a width narrowed only in the section between the first stationary contact 5A and the second stationary contact 5B. This allows the stationary-contact supporting case 4 to secure arc-extinguishing spaces 23 and 24 having required sizes formed with inside surfaces facing the first stationary contact 5A and the second stationary contact 5B, respectively.

Figure 14:
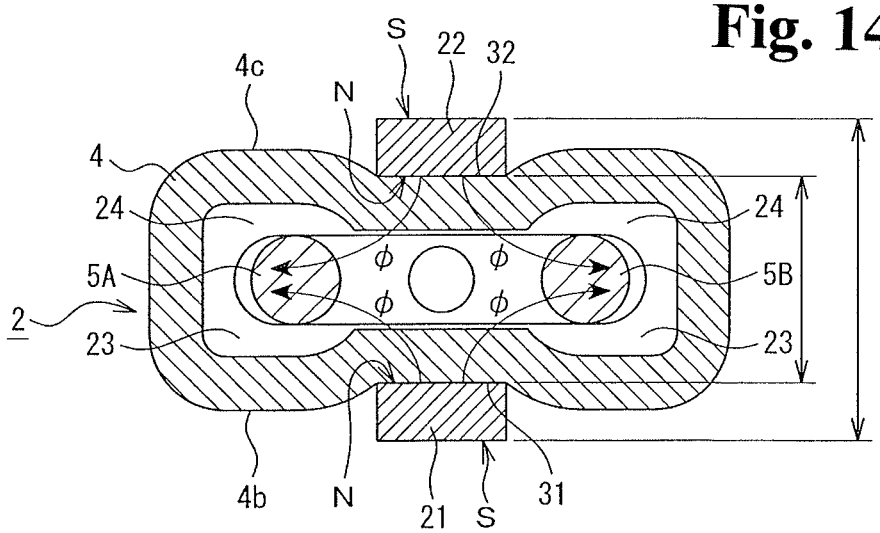
FIG. 14 is a cross-sectional view in the traverse direction showing the magnetic fluxes in a magnetic field formed by a pair of arc-extinguishing magnets of the third embodiment.

According to the third embodiment, as is shown in FIG. 14, a half of magnetic fluxes from the north poles of the arc-extinguishing magnets 21 and 22 are to pass through the section between the stationary contact portion 13 of the first stationary contact 5A and the moving-contact portion 6 outward toward the left in the longitudinal direction. The other half of the magnetic fluxes from the north poles of the arc-extinguishing magnets 21 and 22 are to pass through the section between the stationary contact portion 13 of the second stationary contact 5B and the moving-contact portion 6 outward toward the right in the longitudinal direction.

Figure 15:
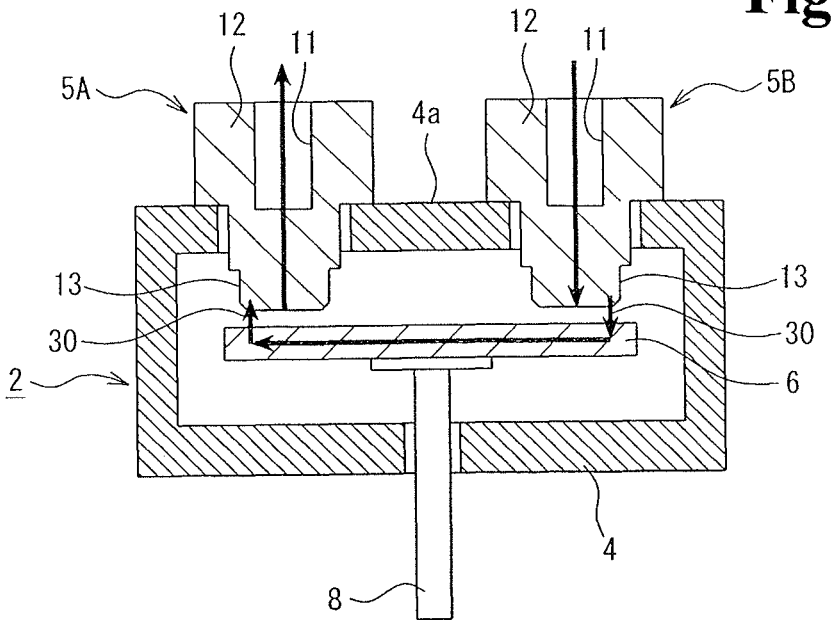
FIG. 15 is a cross-sectional view in longitudinal direction showing the direction of a current of a the third embodiment in FIG. 12.

Thus, as is shown in FIG. 15, in a state with a regenerated current flowing from the second stationary contact 5B side to the first stationary contact 5A side, for example, in the case when the electromagnetic contactor is shifted to a released state, arcs 30 are produced in the section between the stationary contact portion 13 of the first stationary contact 5A and the moving-contact portion 6 and in the section between the stationary contact portion 13 of the second stationary contact 5B and the moving-contact portion 6.

Figure 16:
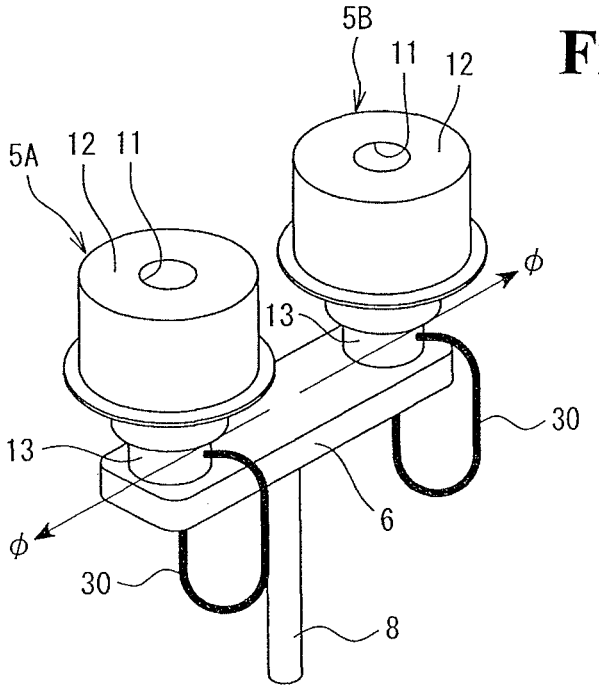
FIG. 16 is a perspective view illustrating extended states of arcs in the electromagnetic contactor of the third embodiment.
Figure 17:
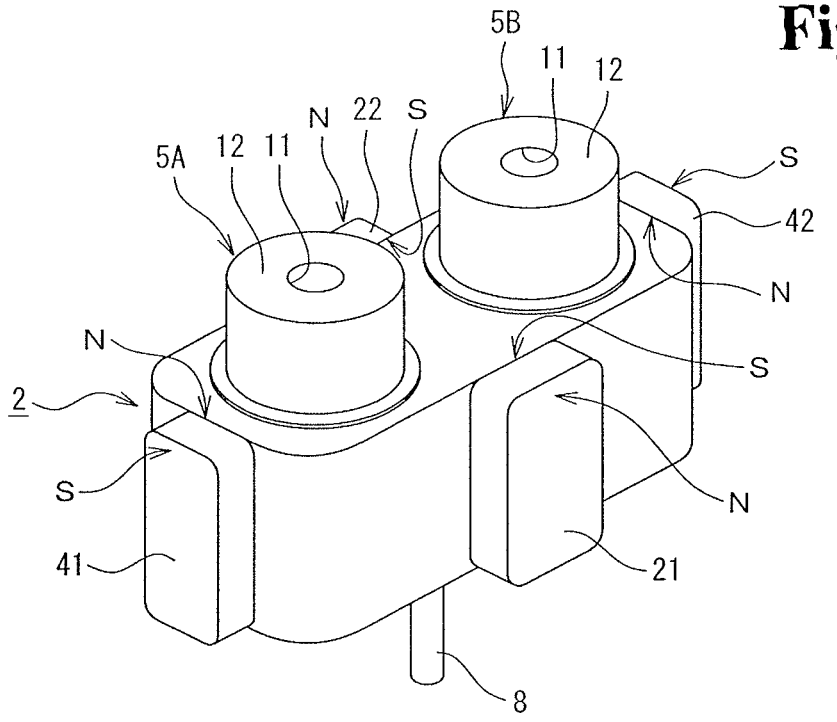
FIG. 17 is a perspective view showing a fourth embodiment of an electromagnetic contactor according to the invention.

At this time, according to the Fleming's left-hand rule, a Lorentz force acts in the direction orthogonal to the direction of the magnetic fluxes from the arc-extinguishing magnet 21 and 22 and orthogonal to the direction of a current. Thus, as is shown in FIG. 16, the arc 30 can be extended onto the arc-extinguishing space 23 side as shown in FIG. 16 to be extinguished. When a current flows from the first stationary contact 5A side to the second stationary contact 5B side, the arc 30 can be extended onto the arc-extinguishing space 24 side to be extinguished. Therefore, also by the third embodiment, a working effect similar to that of the previously explained first embodiment can be obtained.

Furthermore, in the above third embodiment, of the arc-extinguishing spaces 23 and 24, spaces between the first stationary contact 5A and the second stationary contact 5B, which spaces are unnecessary for arc-extinguishing spaces, are made to be narrow to form the holding recesses on the outside. Therefore, an outer dimension including the arc-extinguishing magnets made positioned on the outer side surface of the stationary-contact supporting case 4 can be made smaller compared with the outer dimension of the first embodiment, by which the electromagnetic contactor can be made further downsized.

Incidentally, also in the third embodiment, the polarities of the facing magnetic pole surfaces of the arc-extinguishing magnets 21 and 22 can be changed from the north pole to the south pole.

In the next, a fourth embodiment of the invention will be explained with reference to FIG. 17 to FIG. 22B.

The fourth embodiment is provided so as to make the Lorentz forces due to magnetic fluxes of arc-extinguishing magnets efficiently act on arcs produced in the sections between the stationary contact portion 13 of a first stationary contact 5A and a moving-contact portion 6 and between the stationary contact portion 13 of a second stationary contact 5B and the moving-contact portion 6.

Namely, in the fourth embodiment, the rectangular arc-extinguishing magnets 21 and 22, each with vertically long sides used in the third embodiment, are arranged on the external side surfaces of the stationary-contact supporting case 4 in the section facing between the first stationary contact 5A and the second stationary contact 5B. Moreover, the stationary-contact supporting case 4 has arc-extinguishing auxiliary magnets 41 and 42 arranged on their respective external side surfaces in the longitudinal direction of the moving-contact portion 6.

In addition, the arc-extinguishing magnets 21 and 22 have the magnetic poles of their respective facing magnetic pole surfaces made as the south poles and the magnetic poles of their respective external side magnetic pole surfaces made as the north poles. While, the arc-extinguishing auxiliary magnets 41 and 42 have the magnetic poles of their facing magnetic pole surfaces made as the north poles and their external side magnetic pole surfaces made as the north poles.

Figure 19:
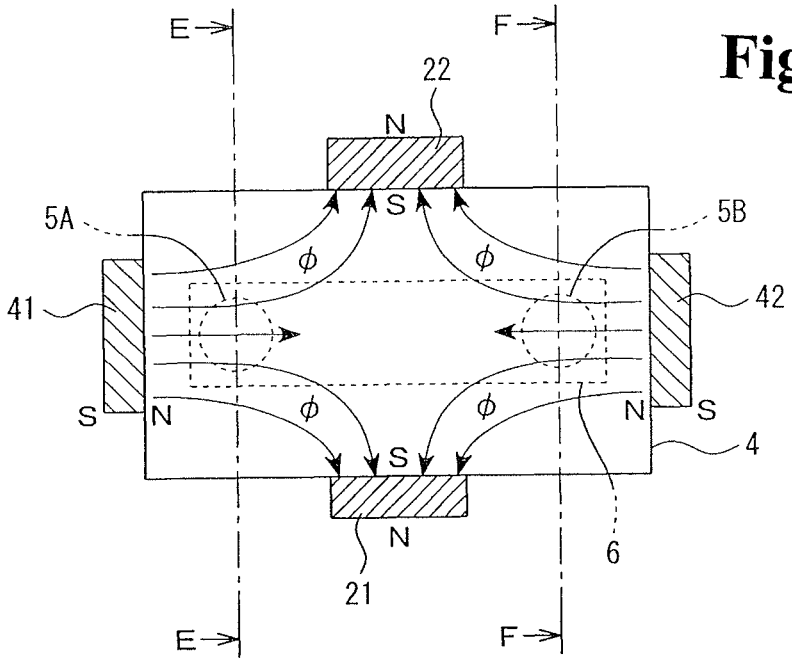
FIG. 19 is an explanatory view showing magnetic fluxes in a magnetic field formed by arc-extinguishing magnets of the fourth embodiment.

Thus, by the arc-extinguishing magnets 21 and 22 and the arc-extinguishing auxiliary magnets 41 and 42, a magnetic field shown in FIG. 19 is formed. Namely, in the magnetic field, letting the side of the arc-extinguishing magnets 21 be the front side and the side of the arc-extinguishing magnet 22 be the rear side, a front side half of the magnetic flux from the north pole on the inner surface side of the arc-extinguishing auxiliary magnets 41 traverses the section between the stationary contact portion 13 of the first stationary contact 5A and the moving-contact portion 6 inward in the longitudinal direction before reaching the south pole on the inner surface side of the arc-extinguishing magnets 21.

Moreover, a rear side half of the magnetic flux from the north pole on the inner surface side of the arc-extinguishing auxiliary magnets 41 traverses the section between the stationary contact portion 13 of the first stationary contact 5A and the moving-contact portion 6 inward in the longitudinal direction before reaching the south pole on the inner surface side of the arc-extinguishing magnets 22.

Similarly, a front side half of the magnetic flux from the north pole on the inner surface side of the arc-extinguishing auxiliary magnets 42 traverses the section between the stationary contact portion 13 of the second stationary contact 5B and the moving-contact portion 6 inward in the longitudinal direction before reaching the south pole on the inner surface side of the arc-extinguishing magnets 21.

Moreover, a rear side half of the magnetic flux from the north pole on the inner surface side of the arc-extinguishing auxiliary magnets 42 traverses the section between the stationary contact portion 13 of the second stationary contact 5B and the moving-contact portion 6 inward in the longitudinal direction before reaching the south pole on the inner surface side of the arc-extinguishing magnets 22.

According to the fourth embodiment, the magnetic flux traversing the section between the stationary contact portion 13 of the first stationary contact 5A and the moving-contact portion 6 and the magnetic flux traversing the section between the stationary contact portion 13 of the second stationary contact 5B and the moving-contact portion 6 are similar to the magnetic fluxes in the previously explained first embodiment.

Figure 18:
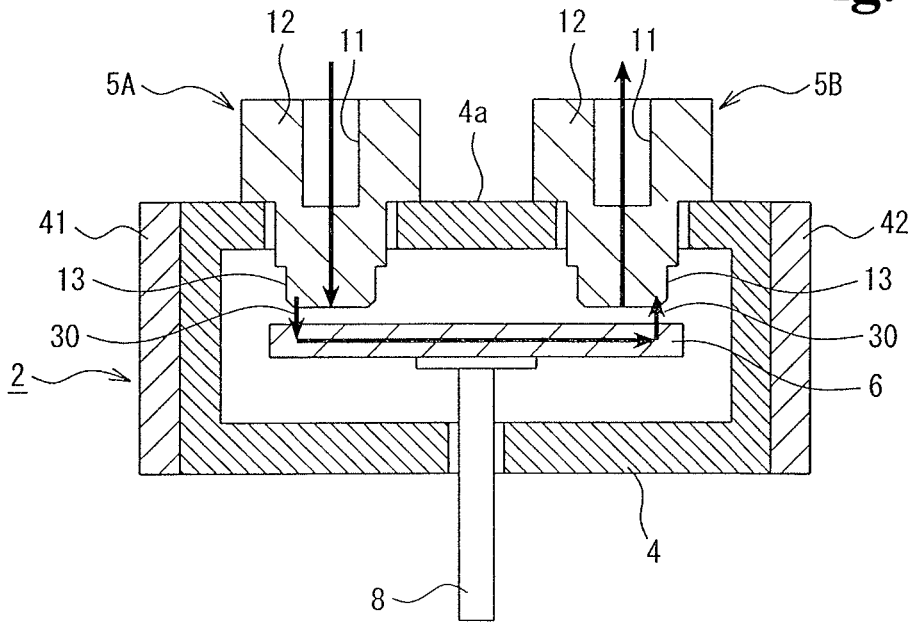
FIG. 18 is a cross-sectional view in longitudinal direction showing the direction of a current of the fourth embodiment in FIG. 17.

Thus, as shown in FIG. 18, when the electromagnetic contactor is shifted from a closed state to a released state in the case in which a current flows from the first stationary contact 5A side to the second stationary contact 5B side through the moving-contact portion 6, arcs 30 are produced as was explained in the foregoing. On each of the produced arcs 30, depending on the directions of the current and the magnetic flux, a Lorentz force acts toward the arc-extinguishing magnet 21 side which is determined according to Fleming's left-hand rule.

Figure 20:
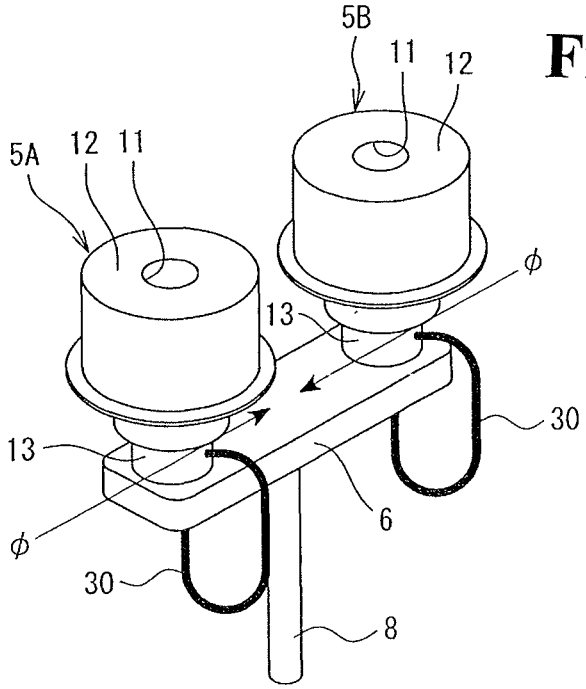
FIG. 20 is a perspective view illustrating extended states of arcs in the electromagnetic contactor of the fourth embodiment.
Figure 21A:
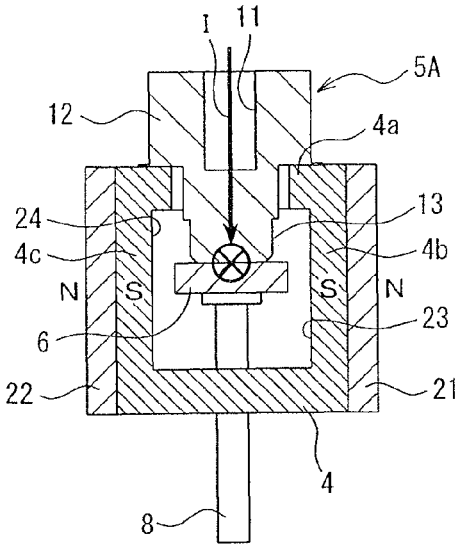
FIG. 21A is a cross-sectional view taken along line E-E in FIG. 19 showing the electromagnetic contactor in a closed state.
Figure 21B:
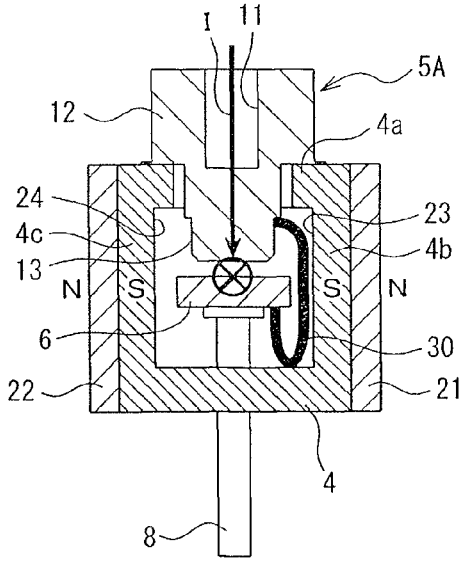
FIG. 21B is a cross-sectional view taken along line E-E in FIG. 19 showing the electromagnetic contactor in a released state.
Figure 22A:
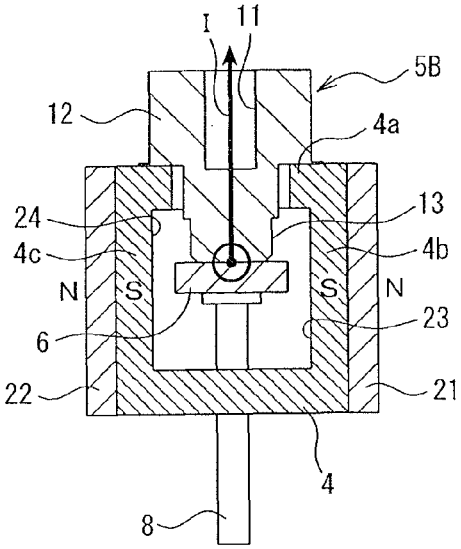
FIG. 22A is a cross-sectional view taken along line F-F in FIG. 19 showing the electromagnetic contactor in a closed state.
Figure 22B:
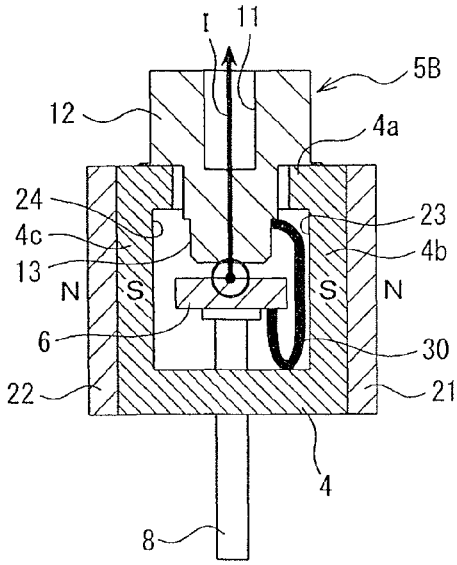
FIG. 22B is a cross-sectional view taken along line F-F in FIG. 19 showing the electromagnetic contactor in a released state.

By the Lorentz force, the produced arcs 30 are largely extended onto the arc-extinguishing space 23 side and extinguished as shown in FIG. 20, FIG. 21B and FIG. 22B. Therefore, a working effect similar to that of the first embodiment can be obtained.

Furthermore, in the fourth embodiment, like in the previously explained second embodiment, by the arc-extinguishing auxiliary magnets 41 and 42, in each of the section between the stationary contact portion 13 of the first stationary contact 5A and the moving-contact portion 6 and the section between the stationary contact portion 13 of the second stationary contact 5B and the moving-contact portion 6, a magnetic field with approximately parallel lines of magnetic flux can be formed. Thus, an arc 30 produced at any position in the stationary contact portion 13 can be extended in the desired direction, namely onto the arc-extinguishing space 23 or 24 side.

Incidentally, also in the fourth embodiment, by also providing the polarities of the facing magnetic pole surfaces of the arc-extinguishing magnets 21 and 22 as the north poles and providing the polarities of the facing magnetic pole surfaces of the arc-extinguishing auxiliary magnets 41 and 42 as the south poles, a working effect similar to that of the fourth embodiment can be obtained.

Following this, a fifth embodiment of the invention will be explained with reference to FIG. 23.

The fifth embodiment is provided so as to increase the magnetic flux density in each of the magnetic field between the facing magnetic pole surface of the arc-extinguishing magnet 21 and the facing magnetic pole surface of the arc-extinguishing auxiliary magnet 41, the magnetic field between the facing magnetic pole surface of the arc-extinguishing magnet 21 and the facing magnetic pole surface of the arc-extinguishing auxiliary magnet 42, the magnetic field between the facing magnetic pole surface of the arc-extinguishing magnet 22 and the facing magnetic pole surface of the arc-extinguishing auxiliary magnet 41 and the magnetic field between the facing magnetic pole surface of the arc-extinguishing magnet 22 and the facing magnetic pole surface of the arc-extinguishing auxiliary magnet 42.

Figure 23:
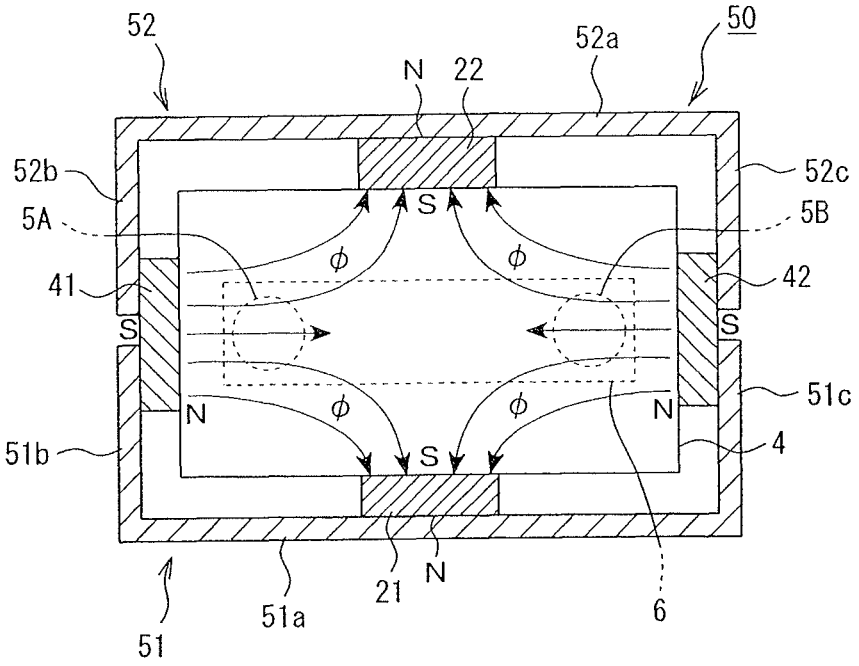
FIG. 23 is a perspective view showing a fifth embodiment of an electromagnetic contactor according to the invention.
Figure 24:
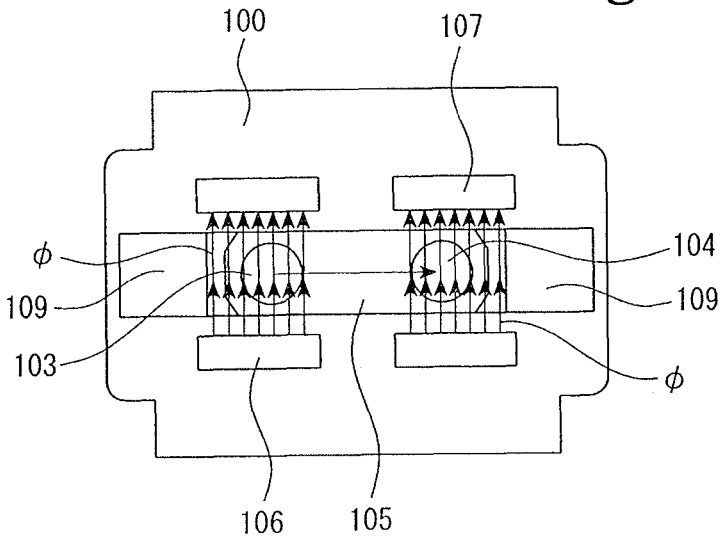
Fig. 24 Prior Art
FIG. 24 is a cross sectional view in traverse direction showing an example of a related plunger electromagnetic relay.
Figure 28:
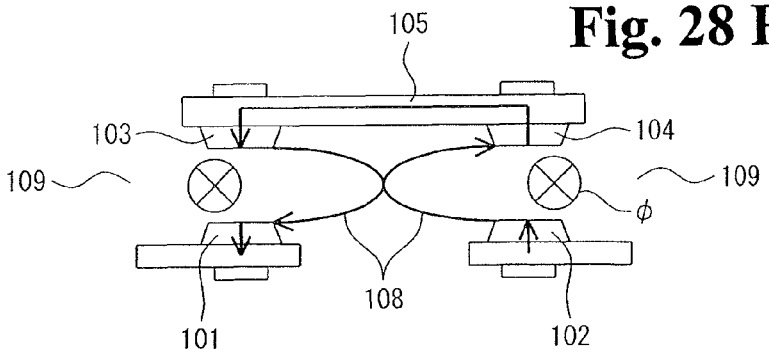
Fig. 28 Prior Art
FIG. 28 is a schematic view showing the same relations as those shown in FIG. 27 in a state when the directions of currents are reversed in the related plunger electromagnetic relay.
Figure 29:
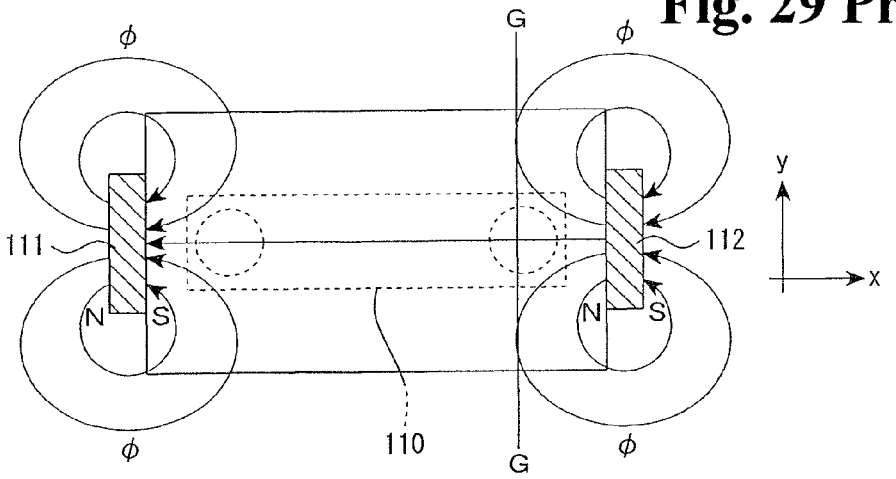
Fig. 29 Prior Art
FIG. 29 is a plan view showing a state of a magnetic field formed in another example of a related electromagnetic relay.
Figure 30:
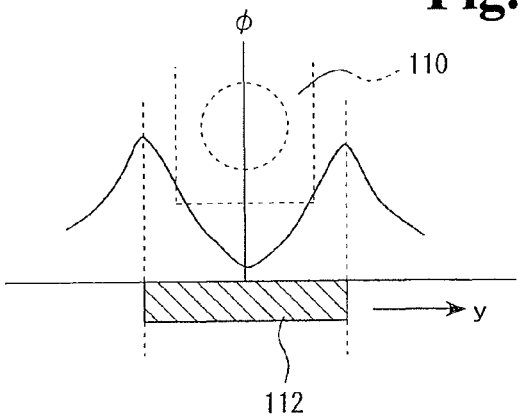
Fig. 30 Prior Art
FIG. 30 is a line graph showing the curves of a magnetic flux density distribution taken along line G-G in FIG. 29.

Namely, the fifth embodiment, as shown in FIG. 23, has the same structure as the structure of the fourth embodiment shown in FIG. 19 except that a yoke 50 is provided which is formed with a pair of yoke sections 51 and 52 made of magnetic material. Thus, in the fifth embodiment, sections equivalent to those shown in FIG. 19 will be denoted with the same reference numerals and signs with detailed explanations thereof omitted.

Here, the yoke section 51 is formed in a C-like shape with a mid plate 51*a* and end plates 51*b* and 51*c*. The mid plate 51*a* is joined onto the surface of the arc-extinguishing magnet 21 on the opposite side to the facing magnetic pole surface thereof and extends rightward and leftward along the stationary-contact supporting case 4. The end plates 51*b* and 51*c* extend backward from the left and right ends of the mid plate 51*a* to be joined to the arc-extinguishing auxiliary magnets 41 and 42 in sections on the surfaces on the opposite side to the facing magnetic pole surfaces of the arc-extinguishing auxiliary magnets 41 and 42 with the sections being shifted slightly toward the front end side from the mid positions of the arc-extinguishing auxiliary magnets 41 and 42, respectively.

In the same way, the yoke section 52 is formed in a C-like shape with a mid plate 52*a* and end plates 52*b* and 52*c*. The mid plate 52*a* is joined onto the surface of the arc-extinguishing magnet 22 on the opposite side to the facing magnetic pole surface thereof and extends rightward and leftward along the stationary-contact supporting case 4. The end plates 52*b* and 52*c* extend forward from the left and right ends of the mid plate 52*a* to be joined to the arc-extinguishing auxiliary magnets 41 and 42 in sections on the surfaces on the opposite side to the facing magnetic pole surfaces of the arc-extinguishing auxiliary magnets 41 and 42 with the sections being shifted slightly toward the rear end side from the mid positions of the arc-extinguishing auxiliary magnets 41 and 42, respectively.

According to the fifth embodiment, the yoke section 51 is joined to the surface on the opposite side to the facing magnetic pole surface of the arc-extinguishing magnet 21 and to the surface on the opposite side to the facing magnetic pole surface of each of the arc-extinguishing auxiliary magnets 41 and 42. Moreover, the yoke section 52 is joined to the surface on the opposite side to the facing magnetic pole surface of the arc-extinguishing magnet 22 and to the surface on the opposite side to the facing magnetic pole surface of each of the arc-extinguishing auxiliary magnets 41 and 42. Therefore, there are formed a closed magnetic circuit including the arc-extinguishing magnet 21, the yoke section 51, the arc-extinguishing auxiliary magnet 41 and the section between the facing magnetic pole surfaces of the arc-extinguishing magnet 21 and the arc-extinguishing auxiliary magnet 41, a closed magnetic circuit including the arc-extinguishing magnet 21, the yoke section 51, the arc-extinguishing auxiliary magnet 42 and the section between the facing magnetic pole surfaces of the arc-extinguishing magnet 21 and the arc-extinguishing auxiliary magnet 42, a closed magnetic circuit including the arc-extinguishing magnet 22, the yoke section 52, the arc-extinguishing auxiliary magnet 41 and the section between the facing magnetic pole surfaces of the arc-extinguishing magnet 22 and the arc-extinguishing auxiliary magnet 41, and a closed magnetic circuit including the arc-extinguishing magnet 22, the yoke section 52, the arc-extinguishing auxiliary magnet 42 and the section between the facing magnetic pole surfaces of the arc-extinguishing magnet 22 and the arc-extinguishing auxiliary magnet 42.

Thus, the presence of the yoke sections 51 and 52 can reduce magnetic resistance between the arc-extinguishing magnet 21 and each of the arc-extinguishing auxiliary magnets 41 and 42, and the magnetic resistance between the arc-extinguishing magnet 22 and each of the arc-extinguishing auxiliary magnets 41 and 42, by which the magnetic flux density in a magnetic field driving an arc can be increased. Hence, a driving force exerted on an arc is increased to make it possible to improve interrupting performance. In addition, it becomes possible with small magnets to form a magnetic field with the strength thereof equivalent to that of a magnetic field in the case without providing the yoke sections 51 and 52, by which the whole structure of the electromagnetic contactor can be downsized.

Furthermore, a pair of the C-like shaped yoke sections 51 and 52 is formed to be mounted on their respective arc-extinguishing magnets 21 and 22 and on the paired arc-extinguishing auxiliary magnets 41 and 42 so that the yoke section 51 joins the arc-extinguishing magnet 21 to the arc-extinguishing auxiliary magnets 41 and 42 and the yoke section 52 joins the arc-extinguishing magnet 22 to the arc-extinguishing auxiliary magnets 41 and 42, by which closed magnetic circuits can be easily formed.

In the fifth embodiment, each of the yoke sections 51 and 52 is formed in the C-like shape. The invention, however, is not limited to this, but allows the yoke sections 51 and 52 to be formed in any shape as long as the yoke section 51 magnetically connects the arc-extinguishing magnet 21 to the arc-extinguishing auxiliary magnets 41 and 42 and the yoke section 52 magnetically connects the arc-extinguishing magnet 22 to the arc-extinguishing auxiliary magnets 41 and 42 to make it possible to form closed magnetic circuits.

While the present invention has been particularly shown and described with reference to the preferred embodiments thereof, it will be understood by those skilled in the art that the foregoing and other changes in form and details can be made therein without departing from the spirit and scope of the present invention.

What is claimed is:

1. An electromagnetic contactor comprising:

a first stationary contact having a stationary contact portion and a stationary terminal portion for connecting to a power supply;

a second stationary contact having a stationary contact portion and a stationary terminal portion for connecting to a load;

a stationary-contact supporting case supporting the first stationary contact and the second stationary contact, the stationary terminal portion of the first stationary contact and the stationary terminal portion of the second stationary contact protruding out of the stationary-contact supporting case and maintaining a predetermined distance inbetween;

a moving-contact portion arranged in the stationary-contact supporting case, and contactable to and separable from the stationary contact portion of the first stationary contact and the stationary contact portion of the second stationary contact;

a pair of arc-extinguishing magnets arranged in parallel to sandwich the moving-contact portion in a direction orthogonal to a longitudinal direction of the moving-contact portion, and having same magnetic polarity at opposing magnetic pole surfaces thereof; and a driving mechanism for driving the moving-contact portion to contact with and separate from the stationary contact portion of the first stationary contact and the stationary contact portion of the second stationary contact, wherein the pair of arc-extinguishing magnets each is disposed on a side surface of the stationary-contact supporting case between the first stationary contact and the second stationary contact.

2. The electromagnetic contactor according to claim 1, wherein the opposing magnetic pole surfaces of the pair of arc-extinguishing magnets are south poles.

3. The electromagnetic contactor according to claim 1, wherein the opposing magnetic pole surfaces of the pair of arc-extinguishing magnets are north poles.

4. The electromagnetic contactor according to claim 1, wherein the stationary-contact supporting case has arc-extinguishing spaces formed inbetween each of inner side surfaces facing the first stationary contact and the moving-contact portion, and inbetween the second stationary contact and the moving-contact portion.

5. The electromagnetic contactor according to claim 1, wherein the stationary-contact supporting case has a holding recess formed on each of external side faces facing a section between the first stationary contact and the second stationary contact for holding each of the pair of arc-extinguishing magnets.

6. The electromagnetic contactor according to claim 5, wherein each of the holding recesses is located between the first and second stationary contact portions to thereby hold the pair of arc-extinguishing magnets close to each other.

7. The electromagnetic contactor according to claim 6, wherein the pair of arc-extinguishing magnets each has a width between the first and second stationary contact portions shorter than a length perpendicular to the width thereof.

8. An electromagnetic contactor, comprising:

a first stationary contact having a stationary contact portion and a stationary terminal portion for connecting to a power supply;

a second stationary contact having a stationary contact portion and a stationary terminal portion for connecting to a load;

a stationary-contact supporting case supporting the first stationary contact and the second stationary contact, the stationary terminal portion of the first stationary contact and the stationary terminal portion of the second stationary contact protruding out of the stationary-contact supporting case and maintaining a predetermined distance inbetween;

a moving-contact portion arranged in the stationary-contact supporting case, and contactable to and separable from the stationary contact portion of the first stationary contact and the stationary contact portion of the second stationary contact;

a pair of arc-extinguishing magnets arranged in parallel to sandwich the moving-contact portion in a direction orthogonal to a longitudinal direction of the moving-contact portion, and having same magnetic polarity at opposing magnetic pole surfaces thereof; and a driving mechanism for driving the moving-contact portion to contact with and separate from the stationary contact portion of the first stationary contact and the stationary contact portion of the second stationary contact, wherein the pair of the arc-extinguishing magnets comprises a pair of first magnets facing the first stationary contact and sandwiching the moving-contact portion inbetween, and a pair of second magnets facing the second stationary contact and sandwiching the moving-contact portion inbetween, and a magnetic polarity of each of opposing magnetic pole surfaces of the pair of first magnets and a magnetic polarity of each of opposing magnetic pole surfaces of the pair of second magnets are different from each other.

9. An electromagnetic contactor, comprising:

a first stationary contact having a stationary contact portion and a stationary terminal portion for connecting to a power supply;

a second stationary contact having a stationary contact portion and a stationary terminal portion for connecting to a load;

a stationary-contact supporting case supporting the first stationary contact and the second stationary contact, the stationary terminal portion of the first stationary contact and the stationary terminal portion of the second stationary contact protruding out of the stationary-contact supporting case and maintaining a predetermined distance inbetween;

a moving-contact portion arranged in the stationary-contact supporting case, and contactable to and separable from the stationary contact portion of the first stationary contact and the stationary contact portion of the second stationary contact;

a pair of arc-extinguishing magnets arranged in parallel to sandwich the moving-contact portion in a direction orthogonal to a longitudinal direction of the moving-contact portion, and having same magnetic polarity at opposing magnetic pole surfaces thereof;

a driving mechanism for driving the moving-contact portion to contact with and separate from the stationary contact portion of the first stationary contact and the stationary contact portion of the second stationary contact; and a pair of arc-extinguishing auxiliary magnets arranged in parallel to sandwich the moving-contact portion at two ends of the moving-contact portion in the longitudinal direction;

wherein a magnetic polarity of facing magnetic pole surfaces of the pair of arc-extinguishing auxiliary magnets is different from the magnetic polarity of the facing magnetic pole surfaces of the pair of arc-extinguishing magnets.

10. The electromagnetic contactor according to claim 9, further comprising a yoke arranged to join sides facing opposite to the magnetic pole surfaces of the pair of arc-extinguishing magnets and sides facing opposite to the magnetic pole surfaces of the pair of arc-extinguishing auxiliary magnets.

11. The electromagnetic contactor according to claim 10, wherein the yoke is formed of a pair of yoke sections each formed in a C-like shape with a mid section thereof joined onto the side facing opposite to the magnetic pole surfaces of the pair of arc-extinguishing magnets, and end sections thereof joined onto the sides facing opposite to the magnetic pole surfaces of the pair of arc-extinguishing auxiliary magnets.

* * * * *